US007527362B2

(12) United States Patent
Hirota

(10) Patent No.: US 7,527,362 B2
(45) Date of Patent: May 5, 2009

(54) INK-JET HAVING AN ARRANGEMENT TO SUPPRESS VARIATIONS IN INK EJECTION

(75) Inventor: Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 252 days.

(21) Appl. No.: 10/800,727

(22) Filed: Mar. 16, 2004

(65) Prior Publication Data

US 2004/0223035 A1 Nov. 11, 2004

(30) Foreign Application Priority Data

Mar. 20, 2003 (JP) ..... 2003-076847

(51) Int. Cl.
*B41J 2/45* (2006.01)
*B41J 2/145* (2006.01)

(52) U.S. Cl. ..... 347/70; 347/40

(58) Field of Classification Search ..... 347/72, 347/71, 54
See application file for complete search history.

(56) References Cited

U.S. PATENT DOCUMENTS 5,266,964 A * 11/1993 Takahashi et al. ..... 347/72
5,402,159 A 3/1995 Takahashi et al.
5,512,793 A * 4/1996 Takeuchi et al. ..... 310/328
5,639,508 A * 6/1997 Okawa et al. ..... 427/100
5,650,809 A * 7/1997 Kitamura ..... 347/55
6,024,439 A * 2/2000 Sueoka et al. ..... 347/50
6,174,051 B1 * 1/2001 Sakaida ..... 347/72
6,176,570 B1 * 1/2001 Kishima et al. ..... 347/70
6,536,880 B2 * 3/2003 Takagi ..... 347/72
6,575,565 B1 6/2003 Isono et al.
6,672,715 B2 1/2004 Isono et al.
6,695,439 B2 * 2/2004 Takahashi ..... 347/72
6,773,095 B2 * 8/2004 Isono ..... 347/72
6,808,254 B2 10/2004 Sakaida et al. ..... 347/71
6,945,636 B2 * 9/2005 Sakaida et al. ..... 347/68
6,979,074 B2 * 12/2005 Watanabe et al. ..... 347/68
6,979,077 B2 * 12/2005 Sakaida ..... 347/71
2001/0030674 A1 * 10/2001 Matsuzawa et al. ..... 347/70
2002/0027579 A1 3/2002 Matsuo et al.

FOREIGN PATENT DOCUMENTS

EP 1 138 493 A1 10/2001
JP A 4-341852 11/1992
JP A 2002-292860 10/2000

(Continued)

*Primary Examiner*—Luu Matthew
*Assistant Examiner*—Shelby Fidler
(74) *Attorney, Agent, or Firm*—Oliff & Berridge, PLC

(57) ABSTRACT

A head main body includes a passage unit in which pressure chambers are arranged adjacent to each other along its surface, and an actuator unit that is fixed to the passage unit to change the volume of the pressure chambers. A piezoelectric sheet constituting a piezoelectric element in the actuator unit spans a plurality of pressure chambers. On a surface of the piezoelectric sheet, formed are not only individual electrodes corresponding to respective pressure chambers but also dummy electrodes. Any individual electrode is surrounded with other individual electrodes or the dummy electrodes arranged in substantially the same pattern. Both the individual electrodes and the dummy electrodes are formed by arranging conductive pastes at predetermined positions on the piezoelectric sheet and then sintering these pastes.

17 Claims, 14 Drawing Sheets

FOREIGN PATENT DOCUMENTS

| | | |
|---|---|---|
| JP | A-2001-162796 | 6/2001 |
| JP | A 2001-334661 | 12/2001 |
| JP | A 2002-166543 | 6/2002 |
| JP | A-2002-225269 | 8/2002 |
| JP | A-2003-080709 | 3/2003 |

* cited by examiner

INK-JET HAVING AN ARRANGEMENT TO SUPPRESS VARIATIONS IN INK EJECTION

BACKGROUND OF THE INVENTION

1. Field of the Invention

The present invention relates to an ink-jet head that ejects ink onto a recording medium to conduct recordings, and also to a method for manufacturing the ink-jet head.

2. Description of Related Art

In some ink-jet heads used in ink-jet recording apparatuses such as ink-jet printers, three linear pressure chambers are arranged on a surface of a passage unit having ink passage as formed therein such that the three linear pressure chambers are adjacent to each other with respect to a perpendicular direction to their linear direction, and, in addition, a piezoelectric actuator spanning the three pressure chambers is arranged on the surface of the passage unit on which the pressure chambers are formed (see U.S. Pat. No. 5,402,159). The piezoelectric actuator has a plurality of piezoelectric sheets constituting a piezoelectric element. A common electrode shared by all the pressure chambers and three individual electrodes each corresponding to each pressure chamber are disposed at different levels between the plurality of piezoelectric sheets. The common electrode is always kept at the ground potential, while the individual electrodes are under independent potential controls. The piezoelectric sheets are polarized in their thickness direction. Portions of the piezoelectric sheets sandwiched between the individual electrodes and the common electrode act as active portions. When the individual electrodes are set at a different potential from that of the common electrode, the active portions of the piezoelectric sheets expand or contract in their thickness direction. Thereby, the pressure chambers located under the active portions change in volume, and pressure is applied to ink reserved in the pressure chambers, so that the ink is ejected toward a recording medium from nozzles communicating with the pressure chambers in the passage unit.

Both the common electrode and the individual electrodes are formed by arranging conductive pastes in a predetermined pattern on the piezoelectric sheets or on green sheets to develop into the piezoelectric sheets, and then firing to sinter the pastes.

Such a construction may involve a problem that, among nozzles communicating with the respective pressure chambers in a pressure chamber group consisting of a plurality of adjacently-arranged pressure chambers, the nozzles that communicate with pressure chambers located outermost with respect to an arrangement direction of the plurality of pressure chambers and the nozzles that communicate with the other pressure chambers located inside exhibit different ink ejection characteristics from each other. Since a variation in ink ejection characteristics leads to deterioration in quality of images to be printed, suppression of the variation in ink ejection characteristics is of great importance in an ink-jet head.

SUMMARY OF THE INVENTION

An object of the present invention is to provide an ink-jet head capable of suppressing a variation in ink ejection characteristics, and also to provide a method for manufacturing the ink-jet head.

Deformability of active portions of a piezoelectric sheet where individual electrodes are formed in correspondence with pressure chambers in an actuator largely affects ink ejection characteristics. Therefore, in order to achieve the foregoing object, it is required to equalize deformability of all the active portions of the piezoelectric sheet. The inventor has recognized that, after a firing process for electrode formation, typically the electrodes made of metal and the piezoelectric sheet show different shrinkages when they return to ambient temperature because of their different coefficient of thermal expansion, so that residual stresses arise at portions of the piezoelectric sheet where the conductive pastes are arranged, i.e., at positions for forming electrodes that corresponds to the active portions. The residual stresses have large influence on the deformability of the active portions. The inventor has also recognized that the residual stresses affect their surrounding, and has then attributed the aforementioned problem to an arrangement pattern of the conductive pastes in the firing process for electrode formation.

Here, for a specific explanation, the above-described construction having three linear pressure chambers in parallel arrangement will be taken as an example. In a group consisting of three individual electrodes, an individual electrode located outermost with respect to an arrangement direction of the individual electrodes has another individual electrode arranged on one side thereof with respect to the arrangement direction and no electrode arranged on the other side thereof with respect to the arrangement direction. That is, a group consisting of a plurality of adjacently-arranged individual electrodes includes one located outermost with respect to an arrangement direction of the plurality of individual electrodes, and the other located inside. These two kinds of individual electrodes differ from each other in arrangement pattern of other individual electrodes therearound. This is applicable commonly to all the constructions in which only individual electrodes corresponding to respective pressure chambers are arranged adjacent to each other on a surface of a piezoelectric sheet. When conductive pastes are arranged at respective positions and then sintered by firing, for forming individual electrodes having such a pattern on a surface of a piezoelectric sheet, the arrangement pattern of the conductive pastes around each electrode to be formed differs according to whether an electrode to be formed is located outermost or inside in a group. The influences of residual stresses occurred around each electrode also differ. This causes a difference in residual stress arising at respective positions for forming electrodes in the piezoelectric sheet. As a result, the active portions of the piezoelectric sheet have nonuniform deformability, thereby causing a variation in characteristics of ink ejection from the nozzles.

According to a first aspect of the present invention, there is provided an ink-jet head comprising a passage unit in which a plurality of pressure chambers each connected to a corresponding nozzle are arranged adjacent to each other along a plane, and an actuator unit that is fixed to the passage unit to change the volume of the pressure chambers. The actuator unit includes a piezoelectric element that spans a plurality of pressure chambers, a plurality of individual electrodes that have been sintered on a surface of the piezoelectric element at positions corresponding to the respective pressure chambers, and one or more sintered members that are, on the surface of the piezoelectric element provided with the plurality of individual electrodes, spaced from an outermost one of the individual electrodes with respect to an arrangement direction of the plurality of individual electrodes, in an outward direction from the plurality of individual electrodes.

In the aforementioned construction, not only the individual electrodes but also the sintered members are formed on the surface of the piezoelectric element. The sintered members are formed at positions spaced, from the outermost individual electrode with respect to an arrangement direction of the plurality of individual electrodes, in an outward direction from the plurality of individual electrodes. The sintered members are, differently from the individual electrode, positioned in no correspondence with the pressure chambers. In order to form the above-mentioned individual electrodes and sintered members on the surface of the piezoelectric element, conductive pastes are arranged at predetermined positions and then sintered by firing. As the conductive pastes return to ambient temperature after the firing process, as mentioned above, residual stresses arise at portions of the piezoelectric element where the conductive pastes are arranged. In the aforementioned construction, however, presence of the sintered members results in a reduced difference in residual stress arising in the piezoelectric element, between the position for forming the individual electrode located outermost to neighbor the sintered member and the other positions for forming the other individual electrodes located inside. This is because the conductive pastes surrounding the aforementioned two kinds of positions for forming the individual electrodes are arranged in substantially the same pattern to thereby equalize influence of residual stress around the two kinds of positions. In the above-described head, accordingly, the active portions, which correspond to the positions for forming the individual electrodes, of the piezoelectric element can demonstrate uniform deformability to thereby suppress a variation in ink ejection characteristics.

According to a second aspect of the present invention, there is provided a method for manufacturing an ink-jet head comprising the steps of forming a passage unit in which a plurality of pressure chambers each connected to a corresponding nozzle are arranged adjacent to each other along a plane, and forming an actuator unit that changes the volume of the pressure chambers. The actuator-unit forming step including arranging conductive pastes at respective positions on a surface of a piezoelectric element, the positions including a plurality of positions for forming individual electrodes that are arranged corresponding to the respective pressure chambers, and one or more positions spaced from an outermost one of the positions for forming the individual electrode with respect to an arrangement direction of the plurality of positions for forming the individual electrodes, in an outward direction from the plurality of positions, and sintering the conductive pastes. The method for manufacturing an ink-jet head further comprises the step of fixing the actuator unit to the passage unit such that the piezoelectric element spans the plurality of pressure chambers and such that the individual electrodes are positioned in correspondence with the respective pressure chambers, the individual electrodes being formed through the sintering process.

According to the aforementioned method, in arranging the conductive pastes during the actuator-unit forming step, the conductive pastes are arranged, on the surface of the piezoelectric element, not only at positions for forming the individual electrodes but also at outside of the position for forming the individual electrode located outermost with respect to the arrangement direction of the plurality of positions for forming the individual electrodes when the conductive pastes are arranged like this and sintered, for the same reason as mentioned above, the position for forming the individual electrode located outermost and the positions for forming the other individual electrodes located inside become less different from each other in residual stress arising in the piezoelectric element, as compared with a case where the conductive pastes are arranged only at positions for forming the individual electrodes. The actuator unit formed in this way is fixed to the passage unit, to manufacture an ink-jet head in which the active portions, which correspond to the positions for forming the individual electrodes, of the piezoelectric element can demonstrate uniform deformability to thereby suppress a variation in ink ejection characteristics. That is, according to the aforementioned method, the ink-jet head of the first aspect can efficiently be manufactured.

According to a third aspect of the present invention, there is provided a method for manufacturing an ink-jet head comprising the steps of forming a passage unit in which a plurality of pressure chambers each connected to a corresponding nozzle are arranged adjacent to each other along a plane, and forming an actuator unit that changes the volume of the pressure chambers. The actuator-unit forming step including arranging conductive pastes in a region that is, on a surface of a piezoelectric element material having an actuator-unit-region formed thereon, larger than the actuator-unit-region to enclose the actuator-unit-region, the actuator-unit-region including a region corresponding to the plurality of pressure chambers and having a border line same as an outline of the actuator unit, the conductive pastes being arranged in substantially the same repetitive pattern as an arrangement pattern of the pressure chambers on the plane of the passage unit, sintering the conductive pastes, and cutting the piezoelectric element material along the border line of the actuator-unit-region. The method for manufacturing an ink-jet head further comprises the step of fixing the actuator unit to the passage unit such that a piezoelectric element spans the plurality of pressure chambers and such that a plurality of individual electrodes are positioned in correspondence with the respective pressure chambers, the piezoelectric element being obtained through the cutting process, the individual electrodes being ones located inside of a plurality of electrodes that are obtained through the sintering process.

According to the aforementioned method, used is the piezoelectric element material larger than the actuator unit, on which the conductive pastes are arranged, followed by the sintering of the conductive pates and then the cutting of the piezoelectric element material along the border line of the actuator-unit-region, thereby manufacturing the actuator unit. Accordingly, the actuator unit, in which the plurality of individual electrodes corresponding to the respective pressure chambers are surrounded with the sintered members and the residual stresses arising in the piezoelectric element where the respective individual electrodes are formed are uniform, can efficiently be obtained.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
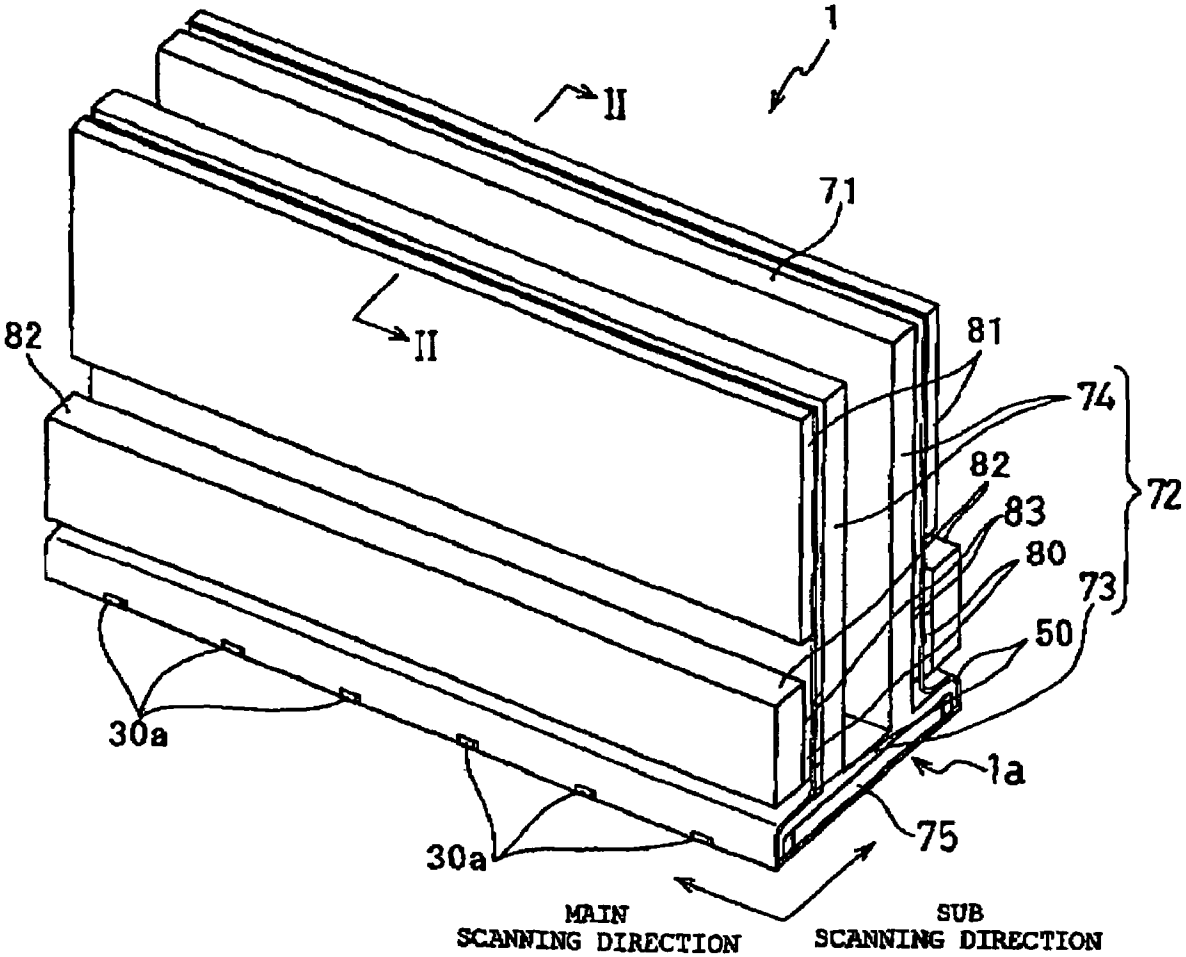
FIG. 1 is a perspective view of an ink-jet head according to an embodiment of the present invention.

A general structure of an ink-jet head according to an embodiment of the present invention will firstly be described with reference to FIGS. 1, 2, and 3.

An ink-jet head 1 is used in an ink-jet printer of line-printing type. As illustrated in FIGS. 1 and 2, the ink-jet head 1 has a head main body 1*a* and a base 71 that supports the head main body 1*a*. The head main body 1*a* has, in a plan view, a rectangular shape extending in one direction of a main scanning direction. The base 71 comprises a base block 75 partially bonded to the head main body 1*a*, and a holder 72 bonded to an upper face of the base block 75 for supporting the base block 75.

The base block 75, made of a metal material such as stainless steel, is a substantially rectangular parallelepiped member having substantially the same length as a longitudinal length of the head main body 1*a*. The base block 75 functions as a light-weight structure for reinforcing the holder 72. The holder 72 is made up of a holder main body 73 disposed near the head main body 1*a*, and a pair of holder supporters 74 each extending from the holder main body 73 in a direction opposite to a head main body 1*a* side. Each holder supporter 74 is configured as a flat plate member. These holder supporters 74 extend along a longitudinal direction of the holder main body 73 and are disposed in parallel with each other at a predetermined distance therebetween.

An elastic member 83 such as a sponge is adhered to an outer side face of each holder supporter 74. A flexible printed circuit (FPC) 50 is arranged along the outer side face of each holder supporter 74 with the elastic member 83 interposed between them. A driver IC 80 is fixed to the FPC 50 so as to confront the elastic member 83. The FPC 50 contains therein a conductive pattern for transmitting a drive signal outputted from the driver IC 80 to a later-described actuator unit 21. The FPC 50 is electrically connected to both the driver IC 80 and the later-described actuator unit 21. A heat sink 82 is disposed in close contact with an outer side face of the driver IC 80. The heat sink 82 of nearly rectangular parallelepiped shape efficiently dissipates heat generated in the driver IC 80.

A substrate 81 is placed outside the FPC 50 above the heat sink 82. Above the substrate 81, disposed is a controller (not illustrated) that conducts a general control over the ink-jet head 1. The driver IC 80, which is connected to the substrate 81, is capable of an individual potential control over each of many pressure chambers 10 (see FIG. 5) formed in a passage unit 4 as will be described later.

Figure 2:
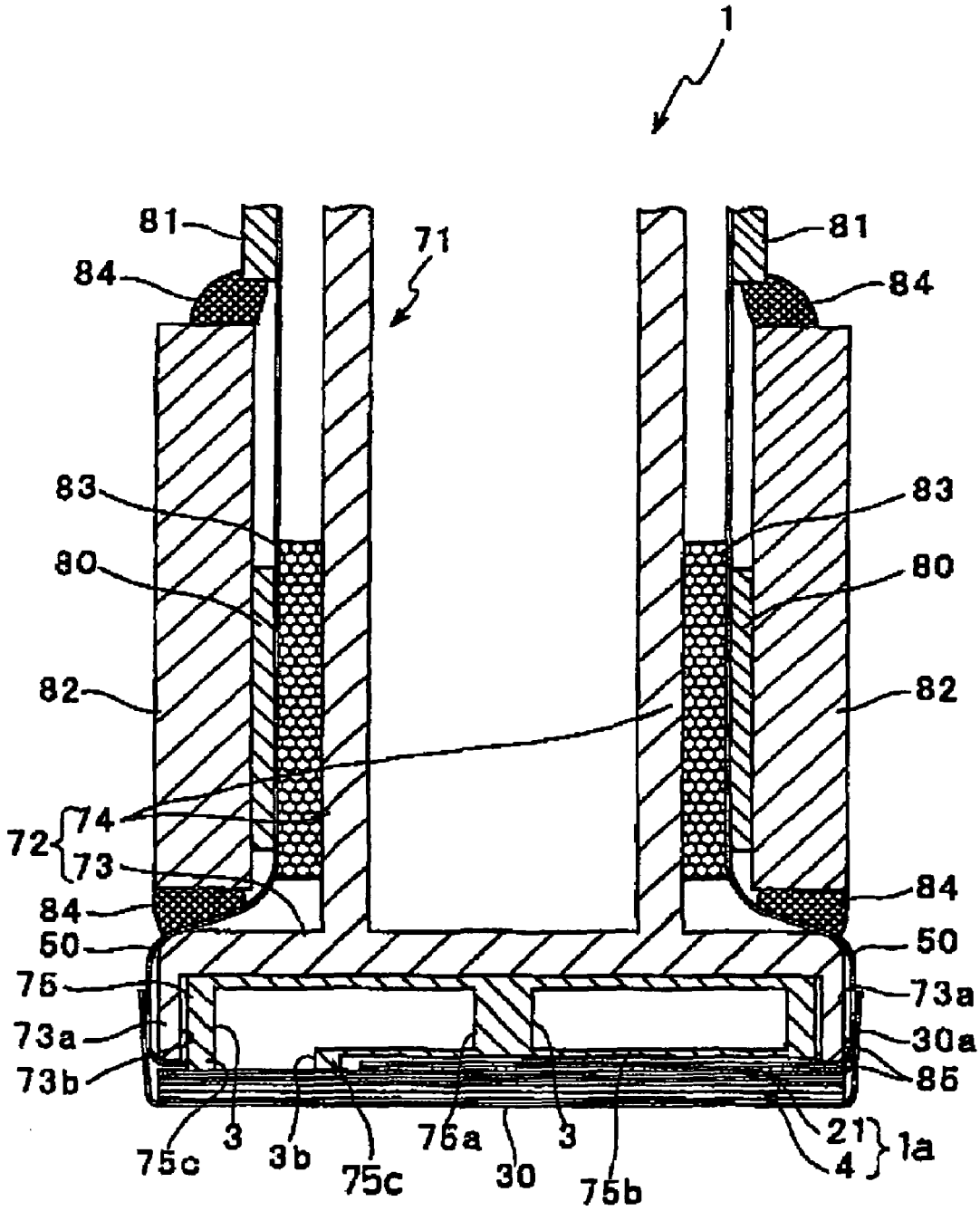
FIG. 2 is a sectional view taken along a line II-II of FIG. 1.

As illustrated in FIG. 2, seal members 84 are arranged between the heat sink 82 and the substrate 81 and between the heat sink 82 and the FPC 50. They are secured to each other with interposition of the seal member 84.

As illustrated in FIG. 2, a pair of skirt portions 73*a* protruding downward is formed at both ends of the holder main body 73 in a sub scanning direction, i.e., in a direction perpendicular to the main scanning direction (see FIG. 1). Each skirt portion 73*a* is formed throughout a whole length of the holder main body 73, thereby defining a substantially rectangular parallelepiped groove 73*b* on a lower face of the holder main body 73.

The base block 75 is received in the groove 73*b* of the holder main body 73, and has its upper face-bonded to a bottom face of the groove 73*b* with an adhesive and the like. Within the base block 75, formed are two ink reservoirs 3 serving as passages for ink to be supplied to the head main body 1*a*. The ink reservoirs 3 are two substantially rectangular parallelepiped spaces (hollow regions) extending along a longitudinal direction of the base block 75. The two ink reservoirs 3 are arranged along the longitudinal direction of the base block 75 in parallel to each other at a predetermined distance with interposition of a partition 75*a* formed along the longitudinal direction of the base block 75. In FIG. 3, the ink reservoirs 3 formed in the base block 75 are conceptionally illustrated with broken lines.

Referring to FIG. 2, an opening 3*b* (see FIG. 3) communicating with the ink reservoir 3 is formed at a lefthand position, as corresponding to the ink reservoir 3, on a lower face 75*b* of the base block 75. As illustrated in FIG. 3, pairs of openings 3*b* are arranged in a zigzag pattern in an extending direction of the ink reservoirs 3 in areas where the later-described actuator unit 21 is not placed. Each opening 3*b* is provided with a filter (not illustrated) for catching dust and dirt that may be contained in ink. In the lower face 75*b* of the base block 75, a vicinity of the opening 3*b* protrudes downward from surroundings thereof, as illustrated in FIG. 2.

Figure 3:
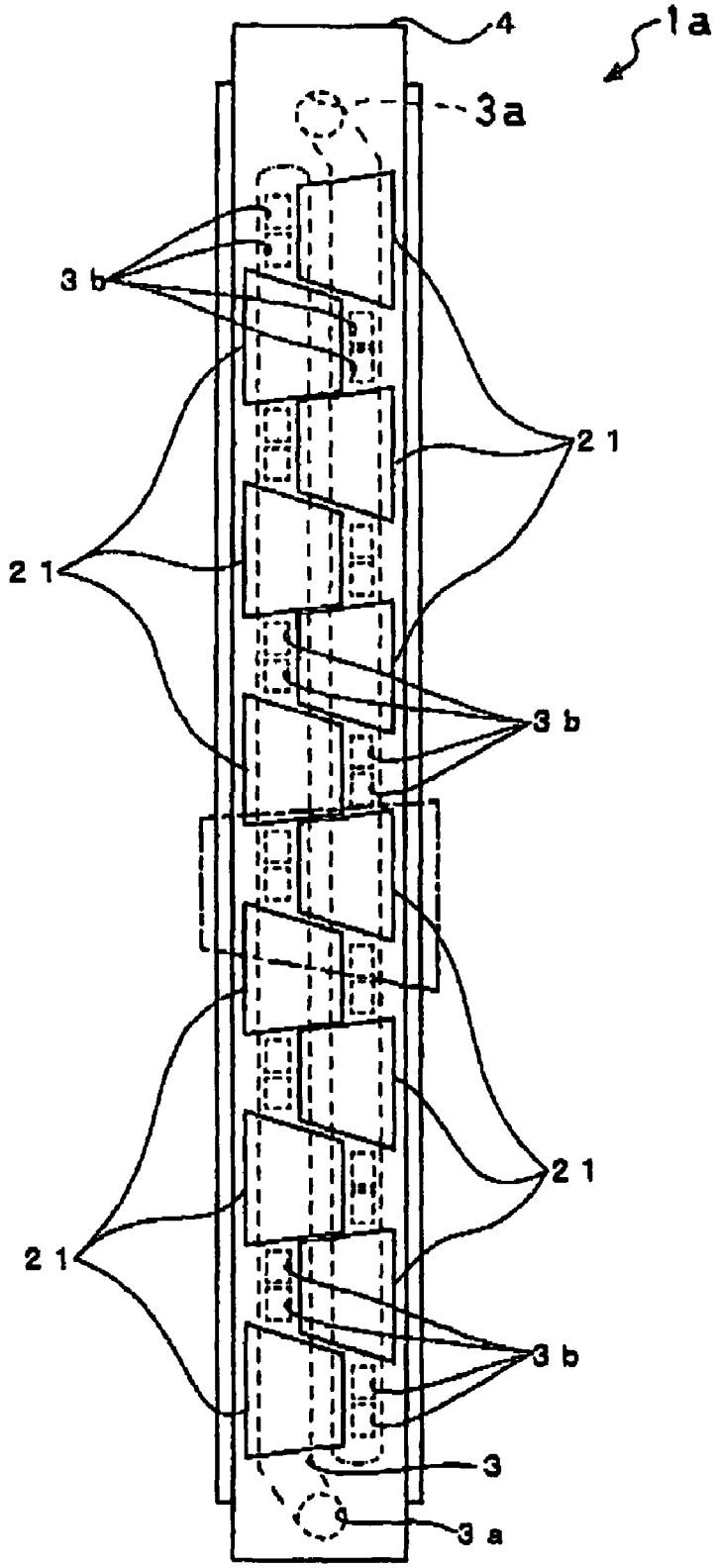
FIG. 3 is a plan view of a head main body included in the ink-jet head illustrated in FIG. 1.

As illustrated in FIG. 3, each ink reservoir 3 communicates at one end thereof with an opening 3*a*. Ink is suitably supplied from an ink tank (not illustrated) via the opening 3*a* to each ink reservoir 3, so that the ink reservoir 3 is always filled up with ink.

As illustrated in FIG. 2, the head main body 1*a* supported below the base block 75 comprises a passage unit 4 and a plurality of actuator units 21 (only one of which is illustrated in FIG. 2) that are bonded to an upper face of the passage unit 4. The base block 75 is bonded to the head main body 1*a* (in more detail, bonded to the passage unit 4 of the head main body 1*a*) only at a vicinity 75*c* of each opening 3*b* of the lower face 75*b*. An area of the lower face 75*b* of the base block 75, other than the vicinity 75*c* of each opening 3*b*, is spaced from the head main body 1*a*. The actuator units 21 are disposed within this space. Thus, the actuator units 21 and the base block 75 are kept out of contact with each other.

Figure 4:
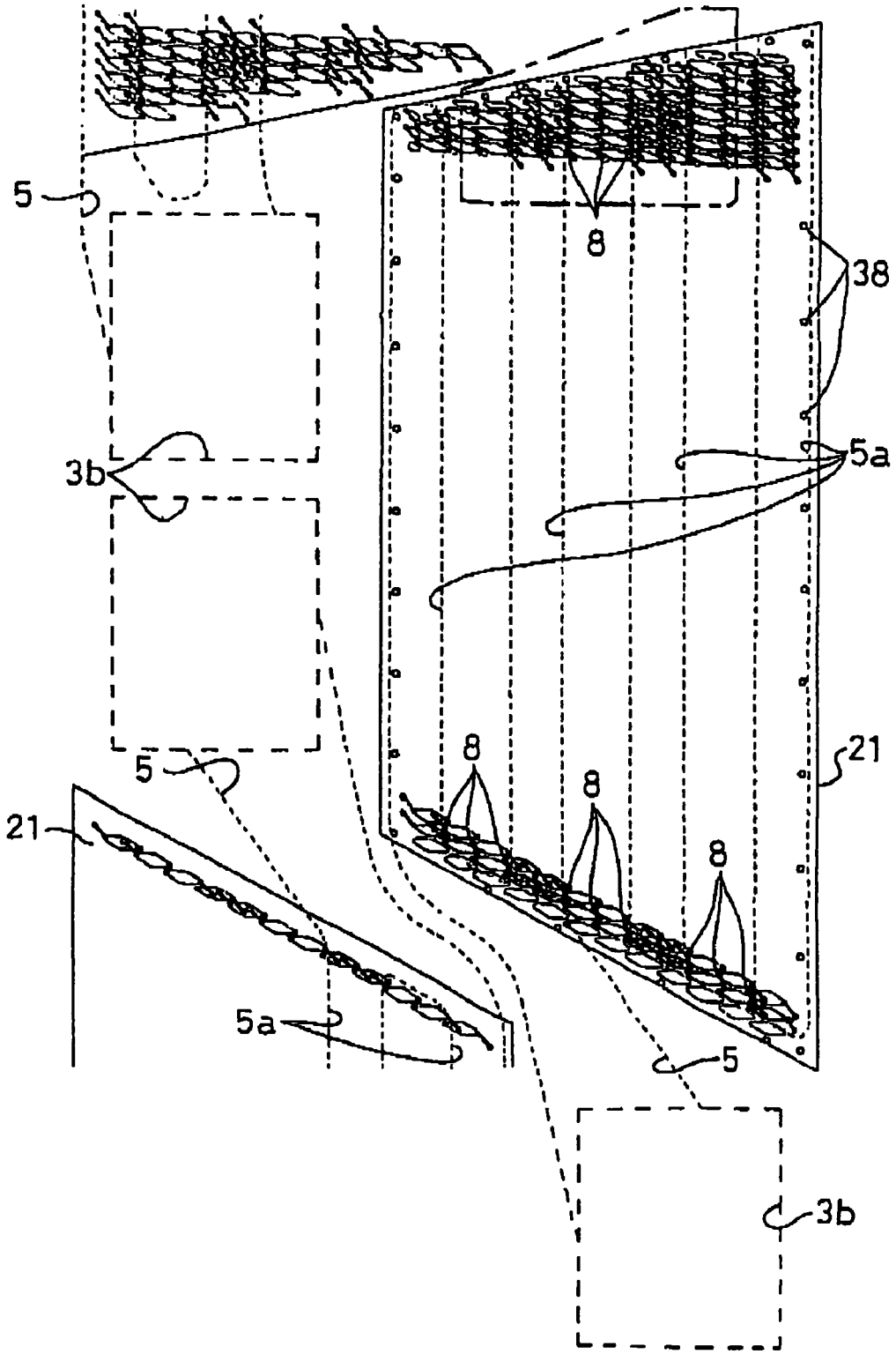
FIG. 4 is an enlarged view of a region enclosed with an alternate long and short dash line illustrated in FIG. 3.

As illustrated in FIG. 3, each actuator unit 21 has, in a plan view, a trapezoidal shape having parallel opposed sides (i.e., upper and lower sides) extending along the longitudinal direction of the head main body 1*a*. The actuator units 21 are arranged between the pairs of openings 3*b* in a zigzag pattern. Neighboring oblique sides of the actuator units 21 overlap each other in a widthwise direction of the head main body 1*a*. Areas of a lower face of the passage unit 4 corresponding to regions bonded to the actuator units 21 are made into ink ejection regions. A large number of nozzles 8 (see FIG. 4) are arranged on a surface of the ink ejection regions, as will be described later. Although FIG. 4 illustrates only a part of the nozzles 8, the nozzles 8 are arranged over a whole region corresponding to the region bonded to the actuator unit 21.

A detailed construction of the actuator unit 21 will be described later.

The FPC 50 is jointed to a surface of the actuator unit 21, as shown in FIG. 2. A seal member 85 is disposed around a tip end of the skirt portion 73*a* of the holder main body 73. This seal member 85 secures the FPC 50 to the passage unit 4 and the holder main body 73. As a result, the FPC 50 is hardly bent even if the head main body 1*a* becomes longer. Moreover, an interconnecting portion between the actuator unit 21 and the FPC 50 can be prevented from receiving stress, and the FPC 50 can be securely held in place.

Referring to FIG. 1, in a vicinity of each lower corner of the ink-jet head 1 along the main scanning direction, six protruding portions 30*a* are disposed at a regular interval along a sidewall of the ink-jet head 1. As illustrated in FIG. 2, these protruding portions 30*a* are provided at both ends, in the sub scanning direction, of a nozzle plate 30 (see FIG. 6) that is a lowermost layer of the head main body 1*a*. That is, the nozzle plate 30 is bent at an angle of approximately 90 degrees along a boundary between each protruding portion 30*a* and the other portion. The protruding portions 30*a* are formed at positions corresponding to vicinities of both ends of various-sized papers to be used for printing. Since bent portions of the nozzle plate 30 are not right-angled but rounded, there is hardly caused a paper jam, which may occur because a leading edge of the paper having been transferred to the head 1 is stopped by a side face of the head 1.

Next, a construction of the passage unit 4 is detailed with reference to FIGS. 4 to 8.

Figure 6:
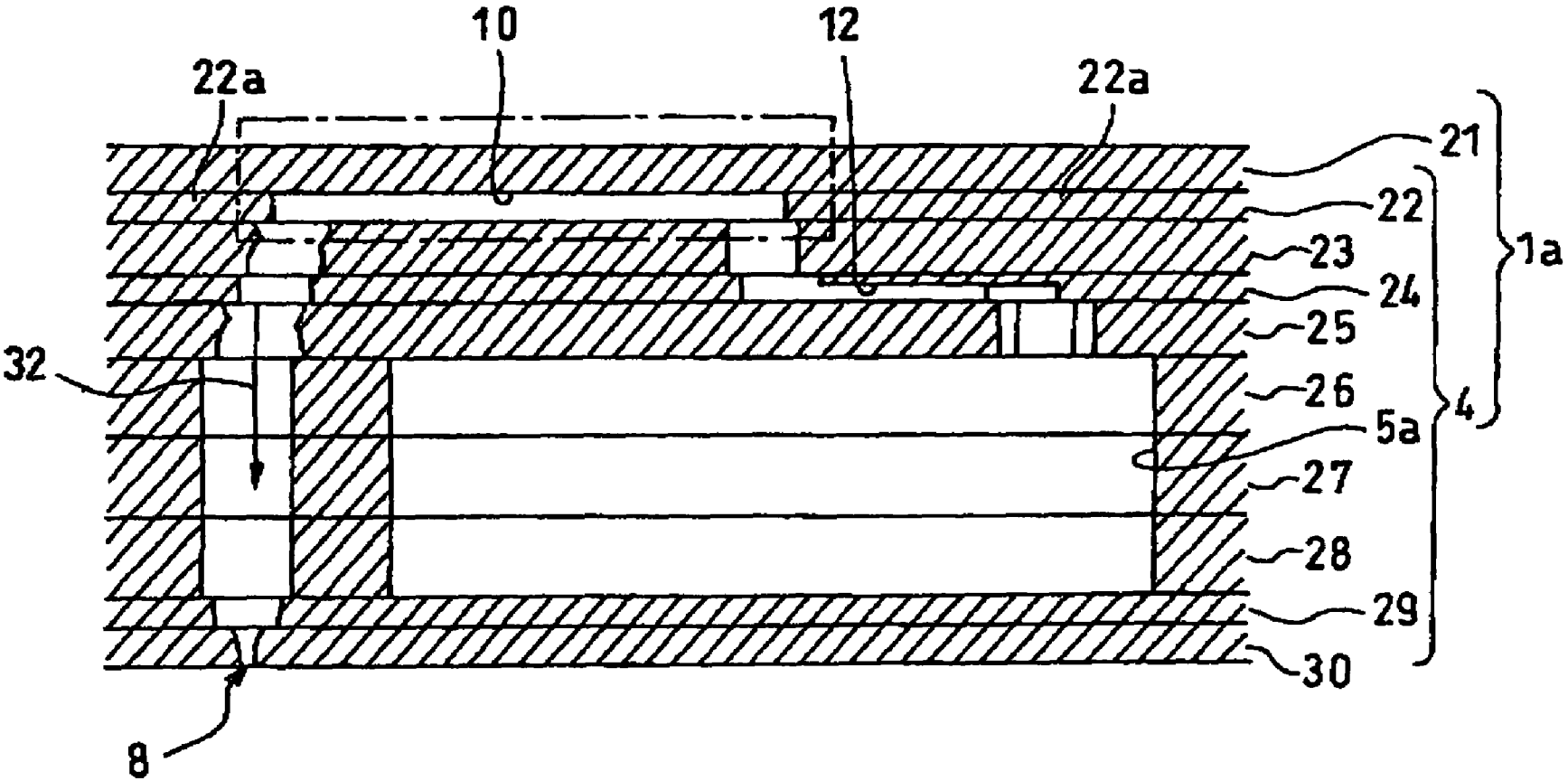
FIG. 6 is a partial sectional view of the head main body illustrated in FIG. 3 as taken along a line VI-VI of FIG. 5.

In the passage unit 4, formed are manifold channels 5 (as illustrated with dotted lines in FIG. 4) communicating with the openings 3*b* so that ink reserved in the ink reservoirs 3 of the base block 75 may be introduced into the manifold channels 5. Front end portion of each manifold channel 5 branches into two sub-manifold channels 5*a*. In a region corresponding to one actuator unit 21, two sub-manifold channels 5*a* extend from each of two openings 3*b* located on both sides of that actuator unit 21 in the longitudinal direction of the ink-jet head 1. That is, in a region of the passage unit 4 corresponding to one actuator unit 21, four sub-manifold channels 5*a* in total extend along the longitudinal direction of the ink-jet head 1. A location, in a sectional view, of each sub-manifold channel 5*a* in the passage unit 4 is as illustrated in FIG. 6. The sub-manifold channels 5*a* are filled up with ink supplied from the ink reservoirs 3.

Referring to FIG. 6, many openings to serve as the pressure chambers 10 are formed in an uppermost plate in the passage unit 4 (i.e., a later-detailed cavity plate 22, to a surface of which the actuator units 21 are to be bonded). Within the ink ejection regions that correspond to areas bonded to the actuator units 21, the pressure chambers 10*a* are arranged adjacently to each other on the surface of the passage unit 4, as illustrated in FIGS. 4 and 5.

As illustrated in FIG. 6, the pressure chamber 10 communicates with the sub-manifold channel 5*a* through an aperture 12. The aperture 12 is for restricting ink flow and thus applying a suitable passage resistance, to thereby stabilize an ink ejection. The aperture 12 is elongated in parallel with the pressure chamber 10, i.e., in parallel with the surface of the passage unit 4. As illustrated in FIG. 5, one end of the aperture 12 is located in a region of the sub-manifold channel 5*a*, and the other end thereof is located at an acute-angled portion of the pressure chamber 10 having a substantially rhombic shape.

Further, referring to FIG. 6, many openings serving as the nozzles 8 are formed in the nozzle plate 30 that is the lowermost layer of the passage unit 4. As illustrated in FIGS. 4 and 5, the nozzles 8 are arranged within the ink ejection region corresponding to the area bonded to the actuator unit 21. The nozzles 8 are positioned outside the ranges of the sub-manifold channels 5*a*, and substantially correspond to one acute-angled portion of the respective pressure chambers 10 of rhombic shape.

Figure 5:
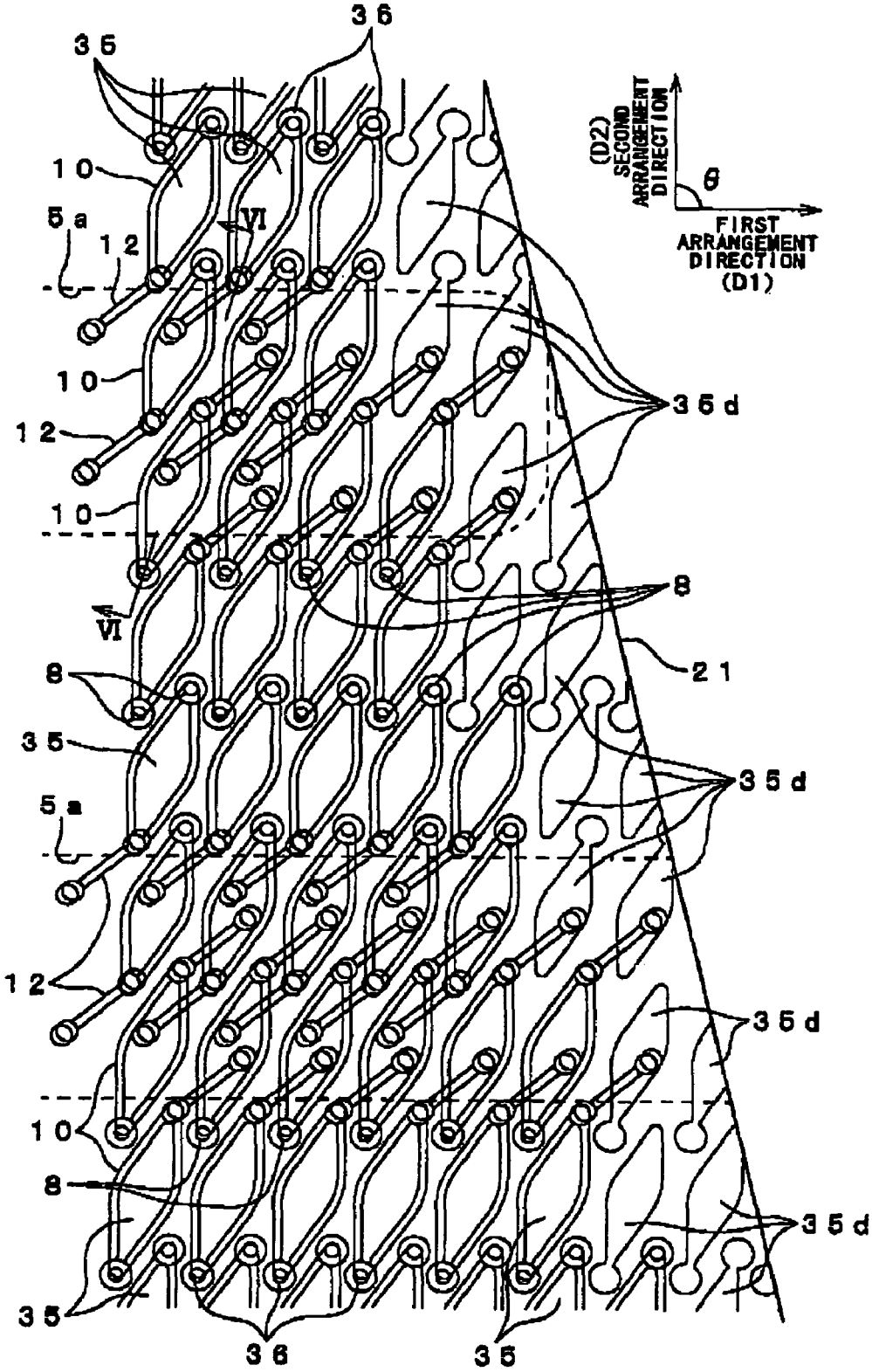
FIG. 5 is an enlarged view of a region enclosed with an alternate long and short dash line illustrated in FIG. 4.

FIGS. 4 and 5 show the lower face of the passage unit 4, and therefore should illustrate with broken lines the pressure chambers 10 and the apertures 12, which are however illustrated with solid lines for easy understanding. In a plan view, one pressure chamber 10 overlaps two apertures 12, an illustrated in FIG. 5. This arrangement is achieved by providing the pressure chambers 10 and the apertures 12 at different levels from each other, as illustrated in FIG. 6. This enables a highly dense arrangement of the pressure chambers 10, and also a high-resolution image formation using the ink-jet head 1 that occupies a relatively small area.

Here will be described an arrangement of the pressure chambers 10 and the nozzles 8 on a plane parallel to the surface of the passage unit 4.

Within the ink ejection regions, both the pressure chambers 10 and the nozzles 8 are adjacently arranged in a matrix in, two directions, i.e., a direction along a length of the ink-jet head 1 as a first arrangement direction referred to as D1 and a direction slightly inclined relative to a width of the ink-jet head 1 as a second arrangement direction referred to as D2. The first arrangement direction D1 and second arrangement direction D2 form an angle theta, θ, somewhat smaller than the right angle. The nozzles 8 are arranged at 50 dpi in the first arrangement direction D1. The pressure chambers 10 are, on the other hand, arranged such that one ink ejection region corresponding to the area bonded to one actuator unit 21 may contain twelve pressure chambers 10 at the maximum in the second arrangement direction D2. An amount of shift in the first arrangement direction D1 caused by arranging twelve pressure chambers 10 in the second arrangement direction D2 is equivalent to one pressure chamber 10. Therefore, throughout a width of the ink-jet head 1, twelve nozzles 8 exist within a range that corresponds to an interval between two neighboring nozzles 8 in the first arrangement direction D1. At both ends of each ink ejection region in the first arrangement direction D1 (i.e., at portions corresponding to oblique sides of each actuator unit 21), one ink ejection region is complementary to another ink ejection region corresponding to an actuator unit 21 located opposite in the widthwise direction of the ink-jet head 1, to thereby satisfy the above-mentioned condition.

Accordingly, the ink-jet head 1 can perform printing at 600 dpi in the main scanning direction by sequentially ejecting ink droplets through the many nozzles 8 arranged in the first and second arrangement directions D1 and D2, in association with relative movement of a paper along the sub scanning direction of the ink-jet head 1.

Figure 7:
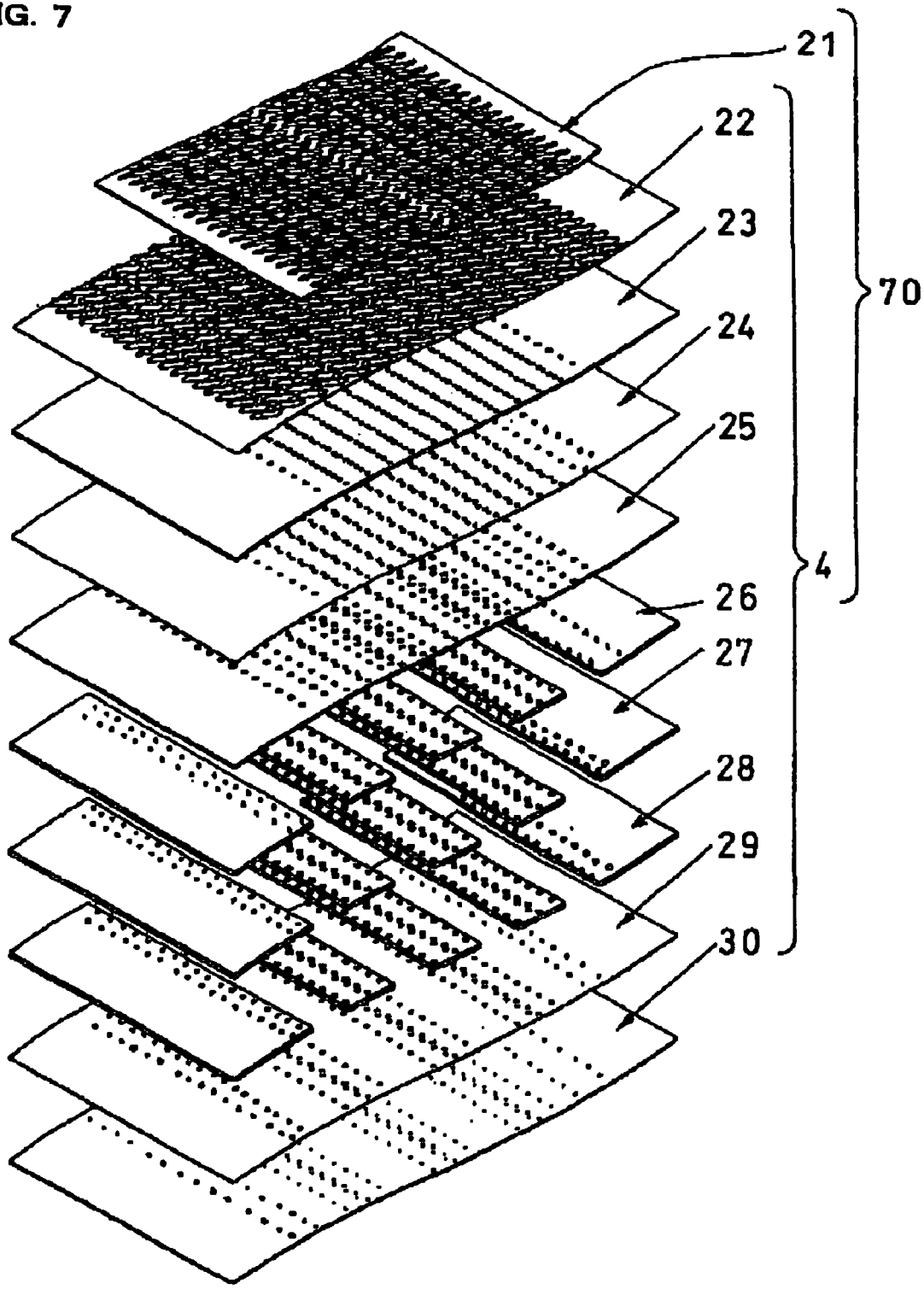
FIG. 7 is a partial exploded perspective view of the head main body illustrated in FIG. 6 plus a flexible printed circuit attached to the head main body.

Referring to FIGS. 6 and 7, the passage unit 4 has a layered structure including nine plates in total, i.e., from the top, a cavity plate 22, a base plate 23, an aperture plate 24, a supply plate 25, manifold plates 26, 27, and 28, a cover plate 29, and a nozzle plate 30. These plates 22 to 30 are made of metal such as stainless steel, etc.

Many, substantially rhombic openings to serve as the pressure chambers 10 are formed in the cavity plate 22. Portions of the cavity plate 22 having no openings formed therein constitute wall portions 22*a* that define the respective pressure chambers 10. In the base plate 23, both of one communication hole between a pressure chamber 10 and a corresponding aperture 12 and one communication hole between a pressure chamber 10 and a corresponding nozzle 8 are provided for each pressure chamber 10 formed in the cavity plate 22. In the aperture plate 24, both of one opening to serve as an aperture 12 and a communication hole between a pressure chamber 10 and a corresponding nozzle 8 are provided for each pressure chamber 10 formed in the cavity plate 22. In the supply plate 25, both of one communication hole between an aperture 12 and a sub-manifold channel 5*a* and one communication hole between a pressure chamber 10 and a corresponding nozzle 8 are provided for each pressure chamber 10 formed in the cavity plate 22. In each of the manifold plates 26, 27, and 28, in addition to an opening to serve as the sub-manifold channel 5*a*, one communication hole between a pressure chamber 10 and a corresponding nozzle 8 is provided for each pressure chamber 10 formed in the cavity plate 22. In the cover plate 29, one communication hole between a pressure chamber 10 and a corresponding nozzle 8 is provided for each pressure chamber 10 formed in the cavity plate 22. In the nozzle plate 30, one tapered opening to serve as a nozzle 8 is provided for each pressure chamber 10 formed in the cavity plate 22.

In the passage unit 4, formed are ink passages 32 (see FIG. 6) each extending from the ink tank (not illustrated), through the ink reservoir 3, the manifold channel 5, the sub-manifold channel 5*a*, the aperture 12, and the pressure chamber 10, to the nozzle 8. The ink passage 32 firstly extends upward from the sub-manifold channel 5*a*, then extends horizontally in the aperture 12, then further extends upward, then again extends horizontally in the pressure chamber 10, then extends downward to a certain extent obliquely away from the aperture 12, and then extends vertically downward toward the nozzle 8.

Figure 8A:
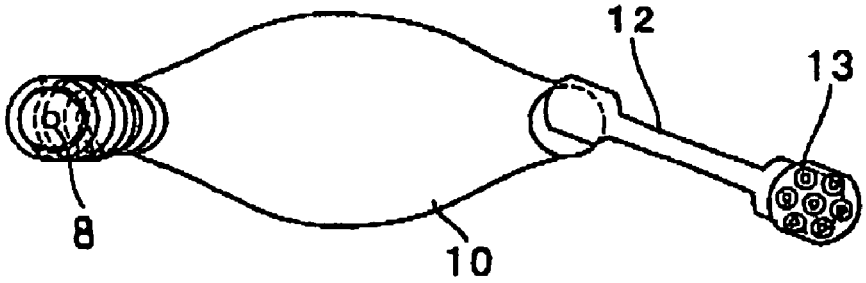
FIG. 8A is a plan view of a space that forms an ink passage illustrated in FIG. 6.
Figure 8B:
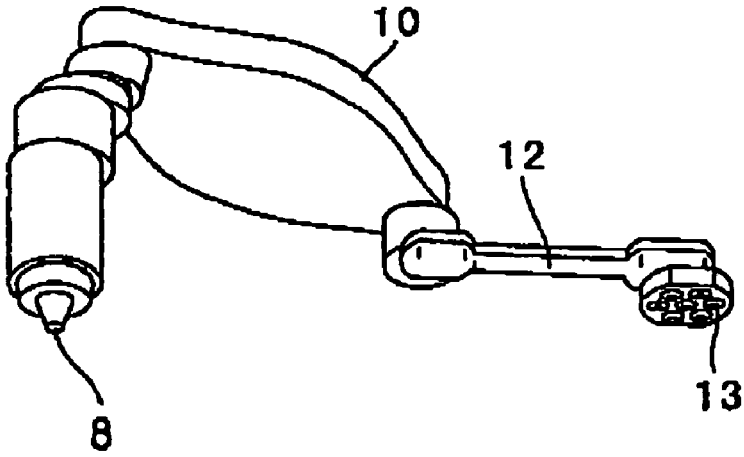
FIG. 8B is a perspective view of the space that forms the ink passage illustrated in FIG. 6.

FIGS. 8A and 8B show a plan view and a perspective view, respectively, of a configuration of a space that forms the ink passage 32 in the passage unit 4 illustrated in FIG. 6. In FIGS. 8A and 8B, shown is a filter 13 provided at a boundary between the aperture 12 and the sub-manifold channel 5*a*. The filter 13 is for removing dust contained in ink.

A construction of the actuator unit 21 will then be detailed with reference to FIGS. 9 and 10.

The actuator unit 21, including four piezoelectric sheets 41, 42, 43, and 44 put in layers, is bonded onto the cavity plate 22 as the uppermost layer of the passage unit 4 with an adhesive layer 70 (see FIG. 9) interposed between them. These piezoelectric sheets 41 to 44 constitute a piezoelectric element. Each of the piezoelectric sheets 41 to 44 has a thickness of approximately 15 μm, and is made of a lead zirconate titanate (PZT)-base ceramic material, which has good workability and ferroelectricity.

The piezoelectric sheets 41 to 44 are formed into a piece of layered flat plate spanning the many pressure chambers 10 formed within one ink ejection region in the ink-jet head 1. As a result, mechanical rigidity of the piezoelectric sheets 41 to 44 can be kept high, and, further, the ink-jet head 1 obtains improved responsiveness for ink ejection.

Individual electrodes 35 having a thickness of approximately 1 μm are formed on the uppermost piezoelectric sheet 41. The individual electrodes 35 correspond to the respective pressure chambers 10. As illustrated in FIG. 10, the individual electrode 35 has a main electrode portion 35*x* and a connecting portion 35*y*. The main electrode portion 35*x* opposes the pressure chamber 10, and has a planar shape of nearly rhomboid (with a length of 850 μm and a width of 250 μm) similar to that of the pressure chamber 10 one acute-angled portion of the main electrode portion 35*x* extends out to form the connecting portion 35*y* that opposes the wall portion 22*a* of the cavity plate 22.

Figure 9:
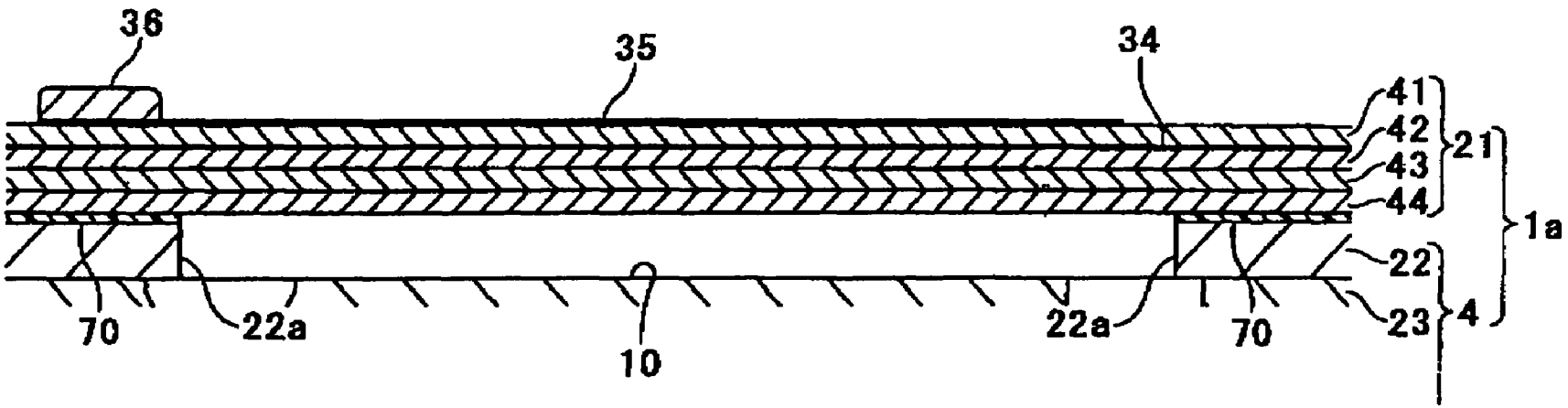
FIG. 9 is an enlarged view of a region enclosed with an alternate long and short dash line illustrated in FIG. 6.
Figure 10:
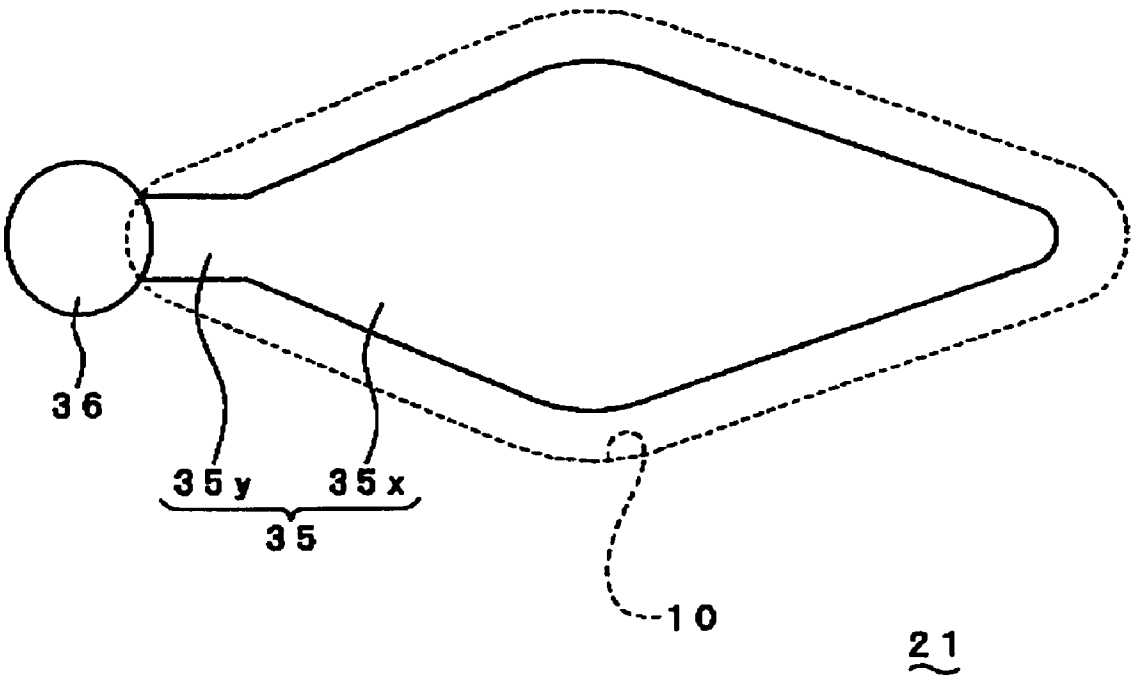
FIG. 10 is a plan view showing shapes of an individual electrode and a land that are formed on a surface of an actuator unit.

As shown in FIGS. 9 and 10, a land 36 is disposed at an end of the connecting portion 35*y* distant from the main electrode portion 35*x*. The land 36 is shaped into a column having a diameter of approximately 160 μm and a thickness of approximately 10 μm. That is, the land 36 is so formed as to oppose the wall portion 22*a* and to be connected to the individual electrode 35. The land 36 is made of, e.g., gold including glass frits.

As illustrated in FIG. 5, the individual electrodes 35 are arranged on the piezoelectric sheet 41 at positions corresponding to the respective pressure chambers 10. As a consequence, the individual electrodes 35 are, similarly to the pressure chambers 10, arranged, on the piezoelectric sheet 41, adjacently to each other in a matrix with respect to two directions of the first and second arrangement directions D1 and D2. In addition, many dummy electrodes 35*d* as sintered members are arranged adjacent to each other at positions on the piezoelectric sheet 41 having no pressure chamber 10 corresponding thereto. The dummy electrodes 35*d* and the individual electrodes 35 have substantially the same shape and the same size and also are made of the same material. An arrangement pattern of these individual electrodes 35 and the dummy electrodes 35*d* on the piezoelectric sheet 41 will be detailed later.

A common electrode 34 having a thickness of approximately 2 μm is interposed between the piezoelectric sheet 41 and the piezoelectric sheet 42 disposed under the piezoelectric sheet 41 (see FIG. 9). The common electrode 34 is a single conductive sheet extending over substantially an entire surface of one actuator unit 21.

The individual electrodes 35, the dummy electrodes 35*d*, and the common electrode 34 are all made of an Ag—Pd-base metallic material. The individual electrodes 35 and the common electrode 34, except for the dummy electrodes 35*d*, serve to change the volume of the pressure chambers 10 by applying an electric field to the piezoelectric sheet 41 for its deformation, as will be detailed later.

No electrode is disposed under the piezoelectric sheet 44, and between the piezoelectric sheet 42 and the piezoelectric sheet 43 disposed under the piezoelectric sheet 42.

The common electrode 34 is electrically connected, via a non-illustrated ground electrode, to a ground conductive pattern (which is formed independently of the conductive pattern connected to the individual electrodes 35) of the FPC 50. Thus, the common electrode 34 is kept at the ground potential equally in its region corresponding to any pressure chamber 10.

A driving method of the actuator unit 21 will here be described.

The piezoelectric sheets 41 to 44 included in the actuator unit 21 have been polarized in their thickness direction. Portions of the piezoelectric sheet 41 sandwiched between the individual electrodes 35 and the common electrode 34 act as active portions. In this condition, when an individual electrode 35 is set at a different potential from that of the common electrode 34 to apply an electric field in a polarization direction to a corresponding active portion of the piezoelectric sheet 41, the active portion expands or contracts in its thickness direction, and, by a transversal piezoelectric affect, contracts or expands in its plane direction that is perpendicular to the thickness direction. On the other hand, the other three piezoelectric sheets 42 to 44 are non-active layers having no region sandwiched between electrodes, and therefore cannot deform by themselves. That is, the actuator unit 21 has a so-called unimorph structure in which an upper piezoelectric sheet 41 distant from the pressure chamber 10 is a layer including active portions and the lower three piezoelectric sheets 42 to 44 near the pressure chamber 10 are inactive layers.

In this construction, when an electric field is applied in the polarization direction to an active portion of the piezoelectric sheet 41, the active portion expands in the thickness direction and contracts in the plane direction while the other three piezoelectric sheets 42 to 44 exhibit no deformation. At this time, since a lowermost face of the piezoelectric sheets 41 to 44 is fixed to upper faces of the wall portions 22*a* of the cavity plate 22 as illustrated in FIG. 9, the piezoelectric sheet 41 to 44 as a whole deform to protrude toward a pressure chamber 10 side, i.e., unimorph deformation, in association with the deformation of the active portion of the piezoelectric sheet 41. This reduces the volume of the pressure chamber 10 and raises pressure of ink in the pressure chamber 10, and thereby the ink is ejected through the nozzle 8. Then, when the individual electrode 35 is again set at the same potential as that of the common electrode 34, the piezoelectric sheets 41 to 44 restore their original shape of flat plate. At this time, the volume of the pressure chamber 10 increases, and accordingly ink in the sub-manifold channel 5*a* is introduced into the pressure chamber 10.

In another possible driving method, all the individual electrodes 35 are in advance kept at a different potential from that of the common electrode 34 so that the piezoelectric sheets 41 to 44 as a whole deform to protrude toward the pressure chamber 10 side. Then, upon every ejection request, a corresponding individual electrode 35 is once set at the same potential as that of the common electrode 34. Thereafter, at a predetermined timing, the individual electrode 35 is again set at the different potential from that of the common electrode 34. In this condition, at a timing when the individual electrode 35 and the common electrode 34 have the same potential, the piezoelectric sheets 41 to 44 restore their original shape of flat plate, and a corresponding pressure chamber 10 thereby increases in volume as compared with its initial state (where the piezoelectric sheets 41 to 44 as a whole deform to protrude toward the pressure chamber 10 side). As the pressure chamber 10 increases in volume, ink in the sub-manifold channel 5*a* is introduced into the pressure chamber 10. Thereafter, at a timing when the potentials of the individual electrode 35 and the common electrode 34 become different from each other, the piezoelectric sheets 41 to 44 as a whole deform to protrude toward the pressure chamber 10 side. This reduces the volume of the pressure chamber 10 and raises pressure of ink in the pressure chamber 10, and thereby the ink is ejected through the nozzle 8.

When, on the other hand, an electric field perpendicular to the polarization direction is applied to an active portion of the piezoelectric sheet 41, the active portion expands in its plane direction and contracts in its thickness direction. At this time, the piezoelectric sheets 41 to 44 as a whole deform to be concaved on the pressure chamber 10 side. This increases the volume of the pressure chamber 10, and thereby ink in the sub-manifold channel 5*a* is introduced into the pressure chamber 10. Then, when a potential of the individual electrode 35 returns to its initial value, the piezoelectric sheets 41 to 44 restore their original shape of flat plate. This reduces the volume of the pressure chamber 10 and raises pressure of ink in the pressure chamber 10, and thereby the ink is ejected through the nozzle 8.

Next, a detailed description will be given to an arrangement pattern of the individual electrodes 35 and the dummy electrodes 35*d* on the piezoelectric sheet 41 of the actuator unit 21.

Figure 11:
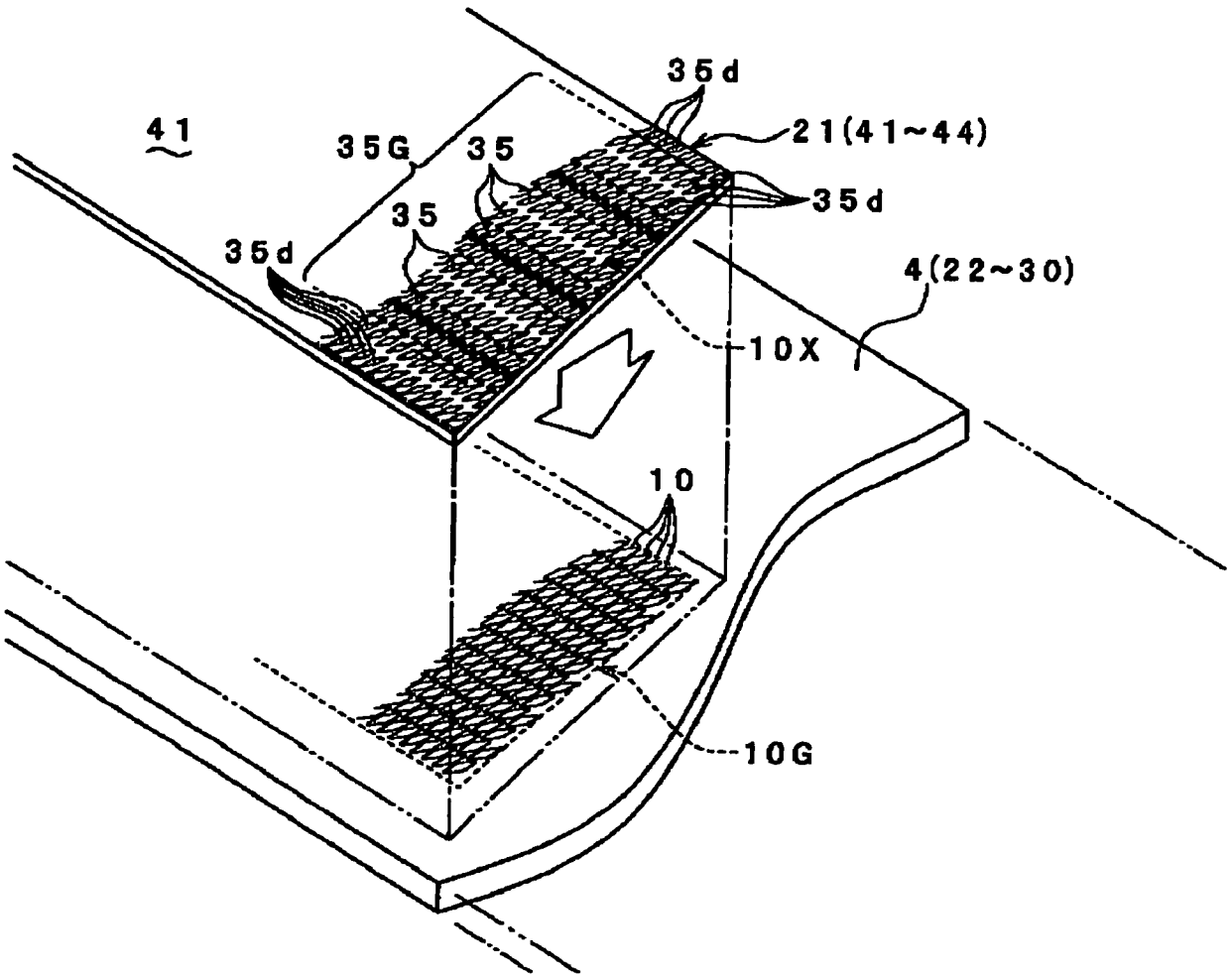
FIG. 11 is a perspective view showing a step of fixing the actuator unit to a passage unit.

First, it can be seen, from the description above and FIG. 11, that the actuator unit 21 covers a group 10G consisting of many pressure chambers 10 arranged adjacent to each other within the ink ejection region on the passage unit 4. In other words, the actuator unit 21 includes trapezoidal piezoelectric sheets 41 to 44 that are one size larger than a frame of a trapezoidal region of the pressure chamber group 10G illustrated with a dashed line in FIG. 11, and the actuator unit 21 is fixed to a portion of the surface of the passage unit 4 illustrated with an alternate long and two short dashes line in FIG. 11 such that the actuator unit 21 may cover a region larger than the region of the pressure chamber group 10G to include the region of the pressure chamber group 10G.

The individual electrodes 35 are arranged within a region 10X , whose border line is illustrated with a dashed line in FIG. 11, at positions corresponding to the respective pressure chambers 10. The region 10X corresponds to the region of the pressure chamber group 10G on the surface of the piezoelectric sheet 41. The dummy electrodes 35*d* are arranged adjacent to each other inside and outside the region 10X so as to surround a group 35G consisting of the many individual electrodes 35. The group 35G corresponds to the pressure chamber group 10G.

The individual electrodes 35 and the dummy electrodes 35*d* are, as a whole, arranged on a surface of the piezoelectric sheet 41 in a repetitive pattern that is substantially identical to an arrangement pattern of the pressure chambers 10. As a result, in the individual electrode group 35G, each individual electrode 35 not located outermost with respect the first and second arrangement direction D1 and D2 i.e., located inside the group 35G, is surrounded with other individual electrodes 35 arranged in a predetermined pattern, and also each individual electrode 35 located outermost with respect to the first and second arrangement direction D1 and D2 is surrounded with other individual electrode 35 and dummy electrode 35*d* arranged in substantially the same pattern as the aforementioned predetermined pattern. Therefore, individual electrodes 35 or dummy electrodes 35*d* surrounding whichever individual electrode 35 included in the individual electrode group 35G are arranged in substantially the same arrangement pattern. A specific explanation will be given with reference to FIG. 12. For example, hatched individual electrodes 35 and dummy electrodes 35*d* surrounding any black individual electrode 35 are arranged in substantially the same arrangement pattern.

Next, an example of methods for manufacturing the ink-jet head 1 will be described. Herein, a detailed description will be given particularly to a method for manufacturing the head main body 1*a*. For manufacturing the head main body 1*a*, the passage unit 4 and the actuator unit 21 are individually prepared and subsequently bonded to each other.

In order to manufacture the passage unit 4, first, each of the nine plates 22 to 30 is subjected to etching with a mask of patterned photoresist, thereby forming openings and recesses as illustrated in FIGS. 6 and 7 in each of the plates 22 to 30. Subsequently, the plates 22 to 30 are overlaid on and bonded to one another with an adhesive such that they may form the ink passage 32 as illustrated in FIG. 6.

In order to manufacture the actuator unit 21, first, a conductive paste to develop into the common electrode 34 is printed in a pattern on a green sheet of a ceramic material to develop into the piezoelectric sheet 42. Green sheets of a ceramic material to develop into the four piezoelectric sheets 41 to 44 are then positioned and overlaid on one another using a jig, and formed into one piece through a firing process at a predetermined temperature. On a resulting piezoelectric element material 21M (see FIG. 13), set is an actuator-unit-region 21X. A border line of the region 21X has a trapezoidal shape that is identical to an outline of the actuator unit 21.

Then, conductive pastes 35P are arranged in a region on a surface of the piezoelectric element material 21M. The region is larger than the region 21X to cover the region 21X, and in this embodiment, an entire surface of the piezoelectric element material 21M serves as this region. The conductive pastes 35P are arranged in substantially the same repetitive pattern as the arrangement pattern of the pressure chambers 10 (see FIG. 13).

At this time, positions where the conductive pastes 35P are arranged include two kinds of positions on the surface of the piezoelectric element material 21M, i.e., on a face corresponding to the surface of the piezoelectric sheet 41. The positions of one kind are a plurality of positions for forming the individual electrodes 35 arranged adjacent to each other in a matrix to correspond to the respective pressure chambers 10. The positions of the other kind are a plurality of positions adjacent to each other so as to surround a group consisting of the plurality of positions for forming the individual electrodes 35 arranged adjacent to each other in a matrix. In other words, the positions of one kind are ones for forming the individual electrodes 35, and the other kind are ones spaced, from the positions for forming the individual electrodes 35 located outermost with respect to the first and second arrangement directions D1 and D2 (see FIG. 12) in the group consisting of the plurality of positions for forming the individual electrodes 35, in an outward direction from the group.

Herein, the conductive pastes 35P are arranged such that all of them may be in a substantially rhombic shape at the respective positions for forming electrodes. The conductive pastes 35P arranged at the respective positions for forming electrodes are made of the same material.

As the conductive pastes 35P, there may be used, for example, a paste obtained by mixing silver fine powder with a binder such as resins and then further mixing a resulting mixture with a viscous medium that comprises an organic resin and a solvent.

Figure 13:
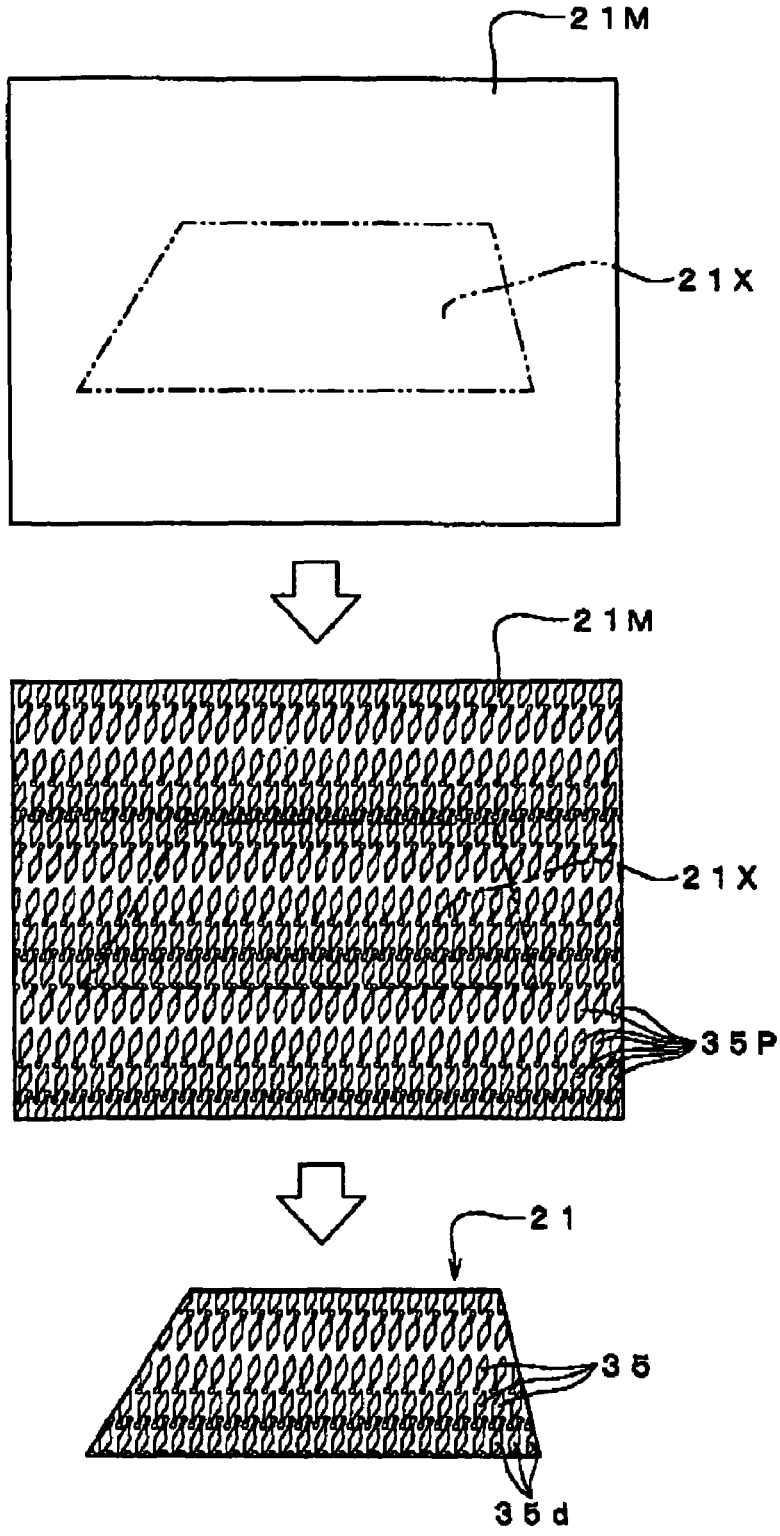
FIG. 13 is schematic plan views stepwisely showing a method for manufacturing the actuator unit.

Next, through a firing process, the conductive pastes 35P are sintered on the surface of the piezoelectric element material 21M, which is then cut along the border line of the trapezoidal actuator-unit-region 21X (see FIG. 13). Metallic films in a substantially uniform repetitive pattern are formed throughout the surface of the actuator unit 21, in more specifically, throughout the surface of the piezoelectric sheet 41. The actuator unit 21 is obtained through the above cutting process. Among these metallic films, ones located at positions corresponding to the pressure chambers 10 are individual electrodes 35, and the others are dummy electrodes 35*d*.

Then, the passage unit 4 and the actuator unit 21 formed in the aforementioned manner are bonded to each other. At this time, the actuator unit 21 and the passage unit 4 are positioned to each other such that the piezoelectric sheets 41 to 44 may span all the pressure chambers 10 in the pressure chamber group 10G (see FIG. 11) and such that the individual electrodes 35 may be positioned in one-to-one correspondence with the pressure chambers 10. In this state, the actuator unit 21 is fixed to the surface of the passage unit 4 on which the pressure chambers 10 are formed.

The head main body 1*a* is manufactured by bonding the passage unit 4 and the actuator unit 21 to each other in this way. Manufacture of the ink-jet head 1 is completed through subsequent predetermined steps.

Figure 12:
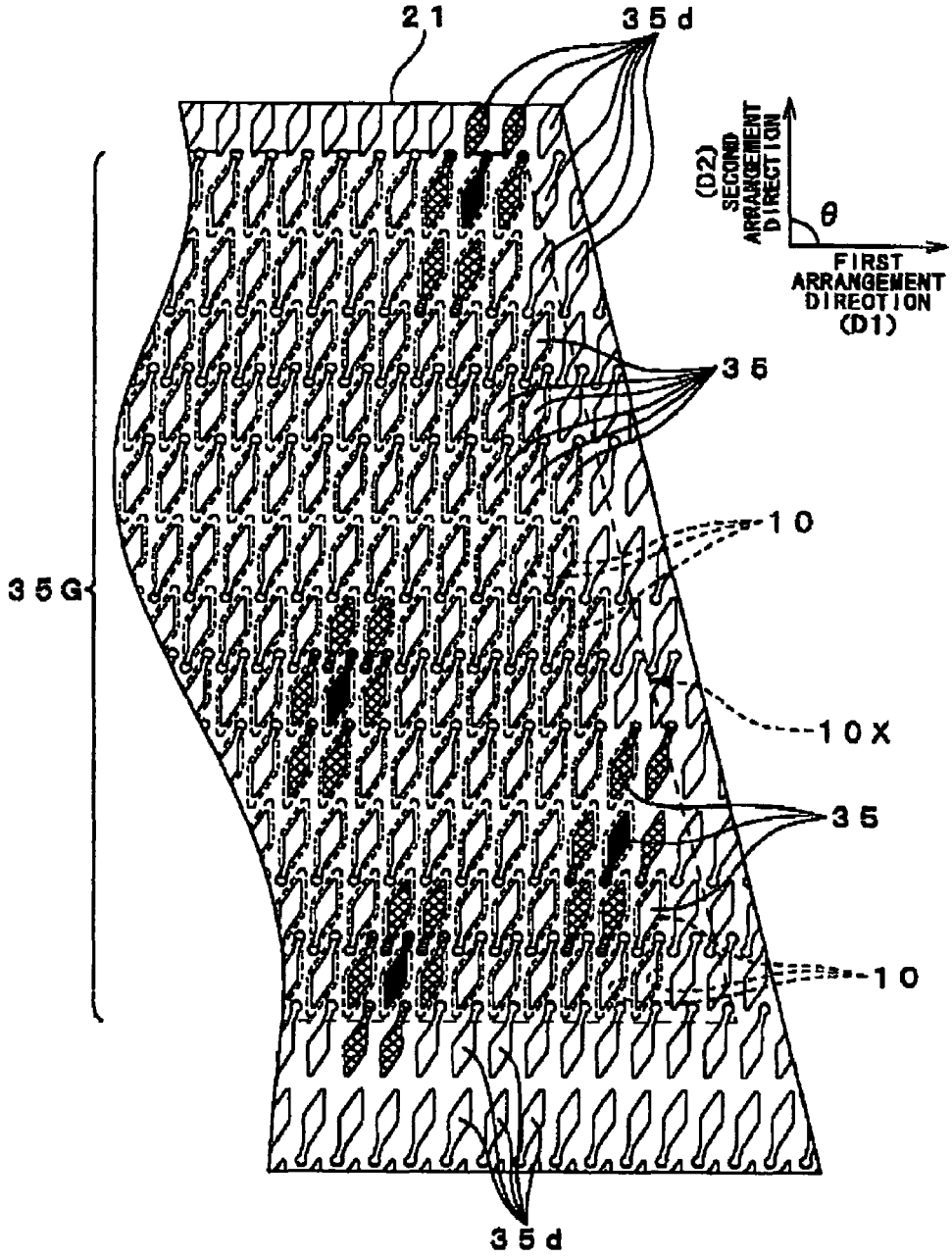
FIG. 12 is an enlarged plan view of a main part showing an arrangement pattern of individual electrodes and dummy electrodes as sintered members on the surface of the actuator unit.

In the ink-jet head 1 of this embodiment, as described above, not only the individual electrodes 35 but also the dummy electrodes 35*d* are formed on the surface of the piezoelectric sheet 41, as illustrated in. FIGS. 11 and 12. The dummy electrodes 35*d* are formed at positions spaced, from the individual electrodes 35 located outermost with respect to the arrangement directions D1 and D2 of the individual electrodes 35 in the group 35G consisting of the plurality of individual electrodes 35, in an outward direction from the group 35G. The dummy electrodes 35*d* are, differently from the individual electrodes 35, positioned in no correspondence with the pressure chambers 10. In order to form such individual electrodes 35 and such dummy electrodes 35*d* on the surface of the piezoelectric sheet 41, the conductive pastes 35P are arranged at predetermined positions and then sintered by firing.

An electrode made of metal is typically larger in coefficient of thermal expansion than the piezoelectric sheet 41, and thereby also larger in shrinkage due to decreased temperature. The electrode fixed to the piezoelectric sheet 41, however, cannot shrink fully when the temperature decreases after the firing. Thereby, tension stress is occurred in the electrode, while compression stress is occurred, under an influence of the tension, at position of the piezoelectric sheet 41 where the electrode is formed. As a result, compressive residual stresses arise at respective portions of the piezoelectric sheet where electrodes are formed.

By unifying shape, size, and material of the individual electrodes 35, the tension stresses produced by the individual electrodes 35 can be uniform regardless of their respective positions. However, in a condition of relatively high-dense arrangement of the individual electrode 35, as in this embodiment, the residual stresses arising at adjacent positions for forming electrodes have influence on each other. This results in a difference in residual stress arising in the piezoelectric sheet, between the position for forming the individual electrode 35 located outermost in the individual electrode group 35G and the other position for forming the individual electrode 35 located inside.

In this embodiment, on the other hand, in order to suppress the variation of the residual stresses, not only the individual electrodes 35 but also the dummy electrodes 35*d* are formed on the surface of the piezoelectric sheet 41. Conductive pastes 35P, which develop into the dummy electrodes 35*d* as well as the individual electrodes 35, are arranged and then sintered by firing. Consequently, the positions for forming the individual electrodes 35 located outermost in the individual electrode group 35G to neighbor the dummy electrodes 35*d* becomes less different, in residual stress arising in the piezoelectric sheet 41, from the positions for forming the other individual electrodes 35 located inside. This is because the conductive pastes 35P surrounding the aforementioned positions for forming the respective individual electrodes 35 are arranged in substantially the same pattern to thereby equalize influence of residual stress generated around the positions.

In the head 1 of this embodiment, accordingly, the active portions, which correspond to the positions for forming the individual electrodes 35, of the piezoelectric sheet 41 can demonstrate uniform deformability to thereby suppress a variation in ink ejection characteristics.

According to the manufacturing method of this embodiment, in arranging the conductive pastes 35P during the step of forming the actuator unit 21, the conductive pastes 35P are arranged, on the surface of the piezoelectric sheet 41, not only at the positions for forming the individual electrodes 35 but also at the outside of the positions for forming the individual electrodes 35 located outermost in a group consisting of the plurality of positions for forming the individual electrodes 35. When the conductive pastes 35P are arranged like this and sintered, for the same reason as mentioned above, the positions for forming the individual electrodes 35 located outermost in the group and the positions for forming the other individual electrodes 35 located inside become less different from each other in residual stress arising in the piezoelectric sheet 41, as compared with a case where the conductive pastes 35P are arranged only at positions for forming the individual electrodes 35. The actuator unit 21 formed in this way is fixed to the passage unit 4, to manufacture the ink-jet head 1 in which the active portions, which correspond to the positions for forming the individual electrodes 35, of the piezoelectric sheet 41 can demonstrate uniform deformability to thereby suppress a variation in ink ejection characteristics. That is, according to the aforementioned method, the ink-jet head 1 of this embodiment can efficiently be manufactured.

In this embodiment, in addition, the dummy electrode 35*d* has substantially the same shape and the same size as those of the individual electrode 35. Thus, the conductive pastes 35P arranged at the positions for forming the respective electrodes have substantially the same shape and the same size, too. Shape and size of the conductive paste 35P affect an amount of its residual stress relative to the piezoelectric sheet 41. By forming the conductive pastes 35P into substantially the same shape and the same size, amounts of residual stresses at the respective positions for forming individual electrodes, though depending on other conditions, can be made uniform. As a result, the active portions of the piezoelectric sheet 41 can demonstrate uniform deformability, to thereby advantageously suppress a variation in ink ejection characteristics with higher reliability.

In this embodiment, moreover, the dummy electrodes 35*d* are made of the same material as that of the individual electrodes 35. That is, the conductive pastes 35P made of the same material are arranged at the respective positions for forming the both electrodes. As a result of this as well, amounts of residual stresses at the respective positions for forming the individual electrodes become equal to each other, to thereby advantageously suppress a variation in ink ejection characteristics with higher reliability.

In this embodiment, as illustrated in FIG. 12, in the individual electrode group 35G, each individual electrode 35 not located outermost with respect to the first and second arrangement direction D1 and D2, i.e., located inside the group 35G, is surrounded with other individual electrodes 35 arranged in a predetermined pattern, and also each individual electrode 35 located outermost with respect to the first and second arrangement direction D1 and D2 is surrounded with other individual electrodes 35 and the dummy electrodes 35*d* arranged in substantially the same pattern as the aforementioned predetermined pattern that is, any one of the positions for forming the individual electrodes 35 is surrounded with the conductive pastes 35P arranged in substantially the same pattern. This enables all the active portions of the piezoelectric sheet 41 corresponding to the individual electrodes 35 to demonstrate uniform deformability, and thus a variation in ink ejection characteristics can be suppressed more advantageously.

Further, the pressure chambers 10 are arranged adjacent to each other in a matrix on the surface of the passage unit 4, which contributes to an excellent densification of the pressure chambers 10, i.e., high resolution. In this condition, the individual electrodes 35 are, similarly to the pressure chambers 10, arranged adjacent to each other in a matrix, too. Here, in this embodiment, the plurality of dummy electrodes 35*d* are arranged adjacent to each other so as to surround the individual electrode group 35G as illustrated in FIGS. 11 and 12, with the result that ink ejection characteristics can be uniformalized. That is, according to this embodiment, both of high resolution and uniform ink ejection characteristics can be obtained.

A construction of the actuator unit is not limited to the one described in the aforementioned embodiment. A possible construction of the actuator unit is as follows.

For example, it is not always necessary that a member constituting the piezoelectric element in the actuator unit spans all the pressure chambers 10 in the pressure chamber group 10G as exemplified by the piezoelectric sheets 41 to 44 of the aforementioned embodiment, as long as the member constituting the piezoelectric element spans a plurality of pressure chambers 10.

Moreover, a member constituting the piezoelectric element in the actuator unit is not limited to a plurality of laminated piezoelectric sheets 41 to 44 as in the aforementioned embodiment, but may be a single piezoelectric sheet.

Additional individual electrodes can be arranged between the piezoelectric sheets 42 and 43. In such a condition, the individual electrodes arranged between the piezoelectric sheets 42 and 43 can be electrically connected, via through holes provided in the piezoelectric sheets 41 and 42, to the individual electrodes 35 arranged on the surface of the piezoelectric sheet 41. Even when, like this, individual electrodes are formed on a plurality of piezoelectric sheets, the present invention may be applied only to the individual electrodes arranged on one piezoelectric sheet at the least. Thus, the present invention is applicable not only to individual electrodes formed on an uppermost surface of a plurality of piezoelectric sheets but also to individual electrodes sandwiched between the plurality of piezoelectric sheets.

An additional common electrode can be arranged between the piezoelectric sheets 43 and 44.

It is not always required that a plurality of dummy electrodes are arranged adjacent to each other so as to surround the individual electrode group 35G as in the aforementioned embodiment. The dummy electrodes may be so arranged as to surround a part of the individual electrode group 35G. In addition, it is not always necessary to provide a plurality of dummy electrodes so that all individual electrodes located outermost in an individual electrode group may neighbor the dummy electrodes. The dummy electrodes may be arranged to neighbor only one of the individual electrodes located outermost in the individual electrode group, at the least. In such conditions, the individual electrodes 35 and the dummy electrodes 35*d* surrounding the respective individual electrodes 35 included in the individual electrode group 35G are not all arranged in substantially the same pattern. However, since the dummy electrodes neighbor at least one of the individual electrodes located outermost in the group, effects of the present invention can be exerted.

Although, in the aforementioned embodiment, the shape, size, and material are substantially the same for both the dummy electrode 35*d* and the individual electrode 35, these factors may not be the same. These factors may be changed as long as the dummy electrode 35*d* and the individual electrode 35 have substantially the same residual stress characteristics, such as intensity and direction of the residual stress, relative to the piezoelectric sheet 41. Also, in order to meet the above requirement regarding residual stress, any other way, e.g. to adjust the condition in the firing process, can be taken. In terms of less number of processes, it is particularly preferable that the dummy electrode 35*d* and the individual electrode 35 are made of the same material.

Figure 14A:
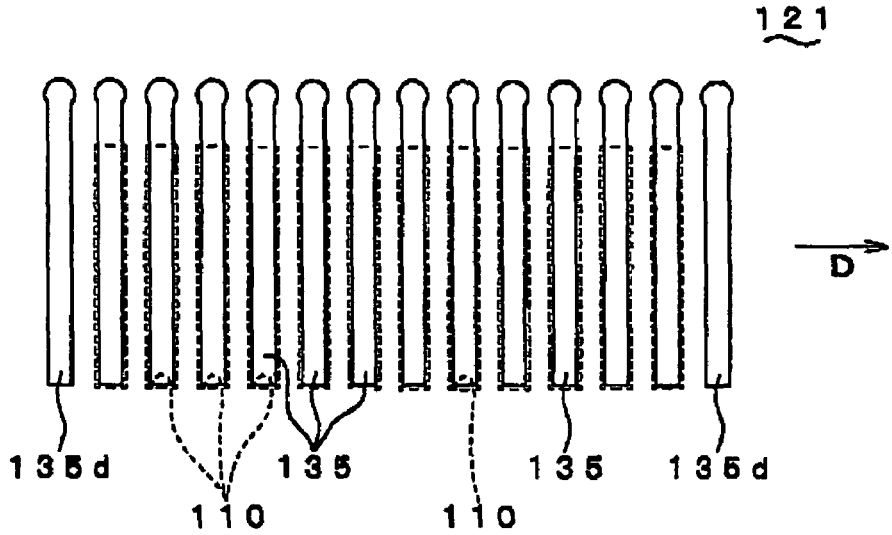
FIGS. 14A and 14B are schematic plan views showing modifications of an arrangement pattern of pressure chambers, the individual electrodes, and the dummy electrodes.

The pressure chambers and the individual electrodes may not always be arranged adjacent to each other in a matrix, but may be adjacently arranged in one direction. FIG. 14A shows an example of possible constructions. In FIG. 14A, pressure chambers 110 having a planar shape of elongated rectangle are arranged adjacent to each other at a regular interval along an arrangement direction D. The individual electrodes 135 are formed elongated on a surface of a piezoelectric sheet of an actuator unit 121 at positions corresponding to the respective pressure chambers 110. A dummy electrode 135*d* is positioned on one side of each of the individual electrodes 135 located at both ends in the arrangement direction D. The dummy electrodes 135*d* are formed at positions in no correspondence with the pressure chambers 110.

Figure 14B:
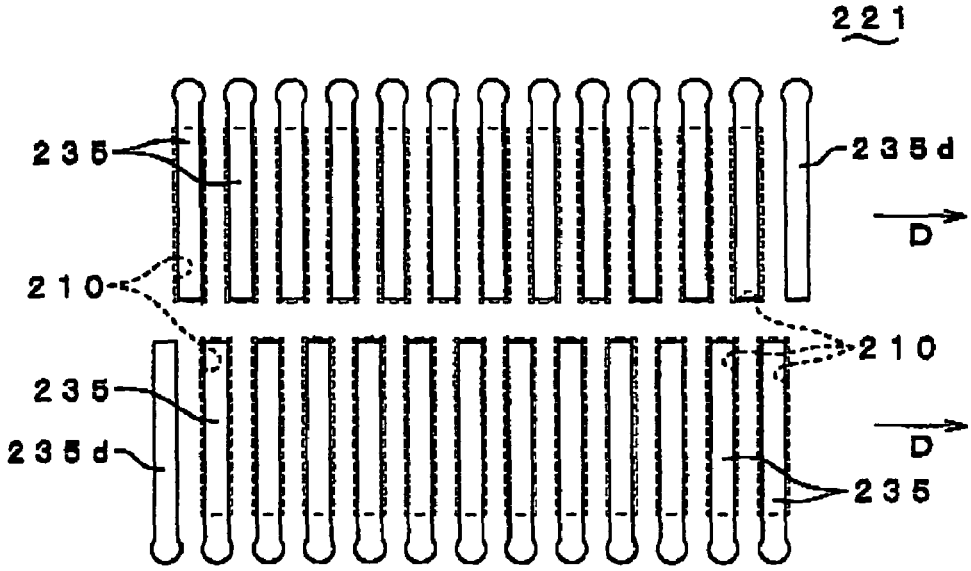

FIG. 14B shows another possible modification of the arrangement of the pressure chambers and the individual electrodes. In FIG. 14D, two groups each consisting of a plurality of pressure chambers 210 are arranged at a distance from each other in a direction perpendicular to an arrangement direction D that is similar to the arrangement direction D in FIG. 14A. The plurality of pressure chambers 210 are arranged adjacent to each other in the arrangement direction D. The pressure chambers 210 included in one pressure chamber group and the pressure chambers 210 included in the other pressure chamber group are slightly out of line with each other in the arrangement direction D to thereby form a zigzag pattern. Individual electrodes 235 are arranged on a surface of a piezoelectric sheet of an actuator unit 221 in one-to-one correspondence with the pressure chambers 210, so that the individual electrodes 235 are arranged in two lines to form a zigzag pattern. Each individual electrode group is provided with one dummy electrode 235*d*. The dummy electrodes 235*d* are arranged at positions spaced from the individual electrodes 235 located outermost in the respective groups such that they may participate in the zigzag arrangement.

In both modifications illustrated in FIGS. 14A and 14B, metallic films including the individual electrodes and the dummy electrodes are arranged in substantially a uniform repetitive pattern. The modification of FIG. 14A has an arrangement pattern in which the metallic films are arranged in a single line at a regular interval. The modification of FIG. 14B has an arrangement pattern in which the metallic films are arranged in two line in a zigzag manner. As a consequence, active portions corresponding to all the individual electrodes 135 or 235 can demonstrate uniform deformability, and thereby a variation in ink ejection characteristics can be suppressed.

The passage unit 4 may be provided also with a dummy pressure chamber that does not contribute to ink ejection. The dummy pressure chamber is different from the pressure chamber of the present invention in that an individual electrode is not formed in correspondence with the dummy pressure chamber. Alternatively, a dummy electrode may be formed in correspondence with the dummy pressure chamber.

A planar shape of the pressure chamber is not limited to a quadrilateral such as rhomboid but may variously be changed, e.g., into circles, ellipses, and the like.

In the manufacturing method of the aforementioned embodiment, as illustrated in FIG. 13, used is the piezoelectric element material 21M larger than the actuator unit 21, on which the conductive pastes 35P are arranged, followed by the firing process to sinter the conductive pates 35P and then the cutting of the piezoelectric element material 21M along the border line of the actuator-unit-region 21X, thereby manufacturing the actuator unit 21. However, this is not limitative. The actuator unit may be manufactured by, for example, configuring in advance a piezoelectric element material into the same size as that of the actuator-unit-region 21X, then arranging the conductive pastes 35P on the piezoelectric element material, and then performing a firing to sinter the conductive pastes 35P. However, from the viewpoint of easiness in forming electrodes, it is preferable, as in the aforementioned embodiment, to use the relatively large-sized piezoelectric element material 21M and to cut the piezoelectric element material 21M after the conductive pastes 35P are arranged thereon and firing process to sinter the conductive pates 35P is performed. In addition, in case that cutting of the piezoelectric element material 21M is followed by arranging the conductive pastes 35P and firing to sinter them, the cut surface of the piezoelectric element material 21M may be deformed. If the actuator unit 21 having the piezoelectric element with the deformed cut surface is bonded to the passage unit 4, the problem may be arise such as adhesion failure caused by a crack or chip along the outline of the piezoelectric element, i.e., along the cut surface. With the view to suppress such a problem, it is preferable, as in the aforementioned embodiment, to cut the piezoelectric element material 21M after the conductive pastes 35P are arranged thereon and firing process to sinter the conductive pates 35P is performed.

The ink-jet head according to the present invention can be used not only in a line-type ink-jet printer that performs printing by conveying a paper relatively to a fixed head main body as in the aforementioned embodiment, but also in a serial-type ink-jet printer that performs printing by, for example, conveying a paper and at the same time reciprocating a head main body perpendicularly to a paper conveyance direction.

Further, an application of the ink-jet head according to the present invention is not limited to ink-jet printers, and it is applicable also to, for example, ink-jet type facsimiles or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head, comprising:

a passage unit in which a plurality of pressure chambers each connected to a corresponding nozzle are arranged adjacent to each other along a plane; and an actuator unit that is fixed to the passage unit to change the volume of the pressure chambers, wherein the actuator unit includes:

a piezoelectric element that spans a plurality of pressure chambers, a plurality of individual electrodes that have been sintered on a surface of the piezoelectric element at positions corresponding to the respective pressure chambers, and that are arranged in two intersecting arrangement directions, and a plurality of dummy electrodes of the same residual stress characteristics as the individual electrodes at positions other than positions corresponding to the pressure chambers and that are, on the surface of the piezoelectric element provided with the plurality of individual electrodes, the dummy electrodes being spaced from an outermost one of the individual electrodes and positioned along each of the two intersecting arrangement directions, in a respective outward direction from the plurality of individual electrodes.

2. The ink-jet head according to claim 1, wherein the dummy electrodes and the individual electrodes have substantially the same residual stress characteristics relative to the piezoelectric element.

3. The ink-jet head according to claim 1, wherein the dummy electrodes and the individual electrodes are made of the same material.

4. The ink-jet head according to claim 3, wherein the dummy electrodes and the individual electrodes have substantially the same shape and the same size.

5. The ink-jet head according to claim 1, wherein each of the individual electrodes, other than the outermost one with respect to the arrangement directions of the plurality of individual electrodes, is surrounded with corresponding ones of the individual electrodes arranged in a predetermined pattern; and wherein the outermost one of the individual electrodes with respect to the arrangement directions of the plurality of individual electrodes is surrounded with a corresponding one of the individual electrodes and a corresponding one of the dummy electrodes arranged in substantially the same pattern as the predetermined pattern.

6. The ink-jet head according to claim 1, wherein:

the plurality of pressure chambers are arranged adjacent to each other in a matrix on the plane of the passage unit;

the plurality of individual electrodes are arranged adjacent to each other in a matrix on the surface of the piezoelectric element at positions corresponding to the respective pressure chambers; and the plurality of dummy electrodes are arranged adjacent to each other so as to surround the plurality of individual electrodes arranged adjacent to each other in a matrix.

7. The ink-jet head according to claim 1, wherein the actuator unit further includes a common electrode that is formed, on a surface of the piezoelectric element opposite to the surface provided with the individual electrodes, to span the plurality of pressure chambers.

8. An ink-jet head, comprising:

a passage unit in which a plurality of pressure chambers each connected to a corresponding nozzle are arranged adjacent to each other in a matrix along a plane; and an actuator unit that is fixed to the passage unit to change the volume of the pressure chambers, wherein the actuator unit includes:

a plurality of piezoelectric elements that are put in layers and cover the plurality of pressure chambers arranged adjacent to each other in a matrix, a plurality of individual electrodes that have been sintered on a surface of one of the plurality of piezoelectric elements and are arranged adjacent to each other in a matrix at positions corresponding to the respective pressure chambers, a plurality of sintered members of the same residual stress characteristics as the individual electrodes at positions other than positions corresponding to the pressure chamber and that are, on the surface of the one of the plurality of piezoelectric elements, arranged adjacent to each other so as to surround the plurality of individual electrodes arranged adjacent to each other in a matrix, the sintered members and the individual electrodes having substantially the same residual stress characteristics relative to the piezoelectric elements, and a common electrode that is formed, on a surface of the one of the piezoelectric elements opposite to the surface provided with the individual electrodes, to span the plurality of pressure chambers.

9. The ink-jet head according to claim 8, wherein the sintered members are spaced from an outermost one of the individual electrodes with respect to two arrangement directions of the individual electrodes, and wherein the two arrangement directions are formed in intersecting planes.

10. An ink-jet head, comprising:

a passage unit in which a plurality of pressure chambers each connected to a corresponding nozzle are arranged adjacent to each other along a plane; and an actuator unit that is fixed to the passage unit to change the volume of the pressure chambers, wherein the actuator unit includes:

a piezoelectric element that spans a plurality of pressure chambers, a plurality of individual electrodes that have been sintered on a surface of the piezoelectric element at positions corresponding to the respective pressure chambers, and that are arranged in two intersecting arrangements directions, and one or more sintered dummy electrodes at positions other than positions corresponding to the pressure chambers and that are, on the surface of the piezoelectric element provided with the plurality of individual electrodes, the sintered dummy electrodes being spaced from an outermost one of the individual electrodes and positioned along each of the two intersecting arrangement directions, in a respective outward direction from the plurality of individual electrodes, and wherein the sintered dummy electrodes and the individual electrodes have substantially the same shape and the same size.

11. The ink-jet head according to claim 10, wherein the sintered dummy electrodes and the individual electrodes have substantially the same residual stress characteristics relative to the piezoelectric element.

12. The ink-jet head according to claim 10, wherein the sintered dummy electrodes and the individual electrodes are made of the same material.

13. The ink-jet head according to claim 10, wherein each of the individual electrodes, other than the outermost one with respect to the arrangement directions of the plurality of individual electrodes, is surrounded with corresponding ones of the individual electrodes arranged in a predetermined pattern; and wherein the outermost one of the individual electrodes with respect to the arrangement directions of the plurality of individual electrodes is surrounded with a corresponding one of the individual electrodes and a corresponding one of the sintered dummy electrodes arranged in substantially the same pattern as the predetermined pattern.

14. The ink-jet head according to claim 10, wherein:

the plurality of pressure chambers are arranged adjacent to each other in a matrix on the plane of the passage unit;

the plurality of individual electrodes are arranged adjacent to each other in a matrix on the surface of the piezoelectric element at positions corresponding to the respective pressure chambers; and a plurality of the sintered dummy electrodes are arranged adjacent to each other so as to surround the plurality of individual electrodes arranged adjacent to each other in a matrix.

15. The ink-jet head according to claim 10, wherein the actuator unit further includes a common electrode that is formed, on a surface of the piezoelectric element opposite to the surface provided with the individual electrodes, to span the plurality of pressure chambers.

16. An ink-jet head, comprising:

a passage unit in which a plurality of pressure chambers each connected to a corresponding nozzle are arranged adjacent to each other in a matrix along a plane; and an actuator unit that is fixed to the passage unit to change the volume of the pressure chambers, wherein the actuator unit includes:

a plurality of piezoelectric elements that are put in layers and cover the plurality of pressure chambers arranged adjacent to each other in a matrix, a plurality of individual electrodes that have been sintered on a surface of one of the plurality of piezoelectric elements and are arranged adjacent to each other in a matrix at positions corresponding to the respective pressure chambers, a plurality of sintered dummy electrodes at positions other than positions corresponding to each of the plurality of pressure chambers and that are, on the surface of the one of the plurality of piezoelectric elements, arranged adjacent to each other so as to surround the plurality of individual electrodes arranged adjacent to each other in a matrix, the sintered dummy electrodes and the individual electrodes having substantially the same residual stress characteristics relative to the piezoelectric elements, and a common electrode that is formed, on a surface of the one of the piezoelectric elements opposite to the surface provided with the individual electrodes, to span the plurality of pressure chambers, wherein the sintered dummy electrodes and the individual electrodes have substantially the same shape and the same size.

17. The ink-jet head according to claim 16, wherein the sintered dummy electrodes are spaced from an outermost one of the individual electrodes with respect to two arrangement directions of the individual electrodes, and wherein the two arrangement directions are formed in intersecting planes.

* * * * *